US007967421B2

(12) United States Patent
Kozuka et al.

(10) Patent No.: US 7,967,421 B2
(45) Date of Patent: Jun. 28, 2011

(54) INK JET PRINT HEAD AND METHOD FOR MANUFACTURING INK JET PRINT HEAD

(75) Inventors: Yuki Kozuka, Kawasaki (JP); Yoshinori Misumi, Tokyo (JP); Ichiro Saito, Yokohama (JP); Sakai Yokoyama, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 731 days.

(21) Appl. No.: 11/960,088

(22) Filed: Dec. 19, 2007

(65) Prior Publication Data

US 2008/0151007 A1 Jun. 26, 2008

(30) Foreign Application Priority Data

Dec. 21, 2006 (JP) ..... 2006-344632

(51) Int. Cl.
*B41J 2/05* (2006.01)
*H01C 17/00* (2006.01)

(52) U.S. Cl. ..... 347/62; 29/610.1

(58) Field of Classification Search ..... 347/62
See application file for complete search history.

(56) References Cited

U.S. PATENT DOCUMENTS

| | | | | |
|---|---|---|---|---|
| 5,550,568 | A | 8/1996 | Misumi | |
| 5,731,828 | A | 3/1998 | Ishinaga et al. | |
| 5,742,307 | A * | 4/1998 | Watrobski et al. | 347/62 |
| 5,880,762 | A | 3/1999 | Ishinaga et al. | |
| 6,224,191 | B1 | 5/2001 | Saito et al. | |
| 6,234,612 | B1 * | 5/2001 | Cornell et al. | 347/62 |
| 6,439,680 | B1 | 8/2002 | Mochizuki et al. | |
| 6,527,813 | B1 | 3/2003 | Saito et al. | |
| 6,568,792 | B2 * | 5/2003 | Andrews et al. | 347/48 |
| 7,344,218 | B2 | 3/2008 | Imanaka et al. | |
| 2004/0223034 | A1 * | 11/2004 | Feinn et al. | 347/67 |
| 2008/0259120 | A1 | 10/2008 | Misumi | |

FOREIGN PATENT DOCUMENTS

| | | |
|---|---|---|
| JP | 10-114071 | 5/1998 |

OTHER PUBLICATIONS

Wikipedia Article-Refractory Metals, Section-Applications.*

* cited by examiner

*Primary Examiner* — Matthew Luu
*Assistant Examiner* — Lisa M Solomon
(74) *Attorney, Agent, or Firm* — Fitzpatrick, Cella, Harper & Scinto

(57) ABSTRACT

The present invention provides an ink jet print head that enables an optimum resistance value to be set for a heating resistor that generates ink ejection energy to allow high-quality images to be printed, as well as a method for manufacturing the ink jet print head. Heating resistors with sheet resistance values differing from each other are formed on the same substrate by heating resistant layers.

6 Claims, 16 Drawing Sheets

INK JET PRINT HEAD AND METHOD FOR MANUFACTURING INK JET PRINT HEAD

BACKGROUND OF THE INVENTION

1. Field of the Invention

The present invention relates to an ink jet print head that ejects ink utilizing thermal energy generated by a heating resistor as an electrothermal converter, and a method for manufacturing the ink jet print head. More specifically, the present invention relates to an ink jet print head comprising an electrothermal converter (heater) composed of a heating resistant film, the ink jet print head being able to print characters, symbols, images, and the like on various print media by ejecting ink to the print media, as well as a method for manufacturing the ink jet print head. The print media include paper, plastic sheets, clothes, and other various articles.

2. Description of the Related Art

An ink jet print head using heating resistors as means for generating ejection energy for ejecting ink bubbles the ink by thermal energy generated by the heating resistors so that the bubbling of the ink can be utilized to eject the ink from ejection ports.

For such ink jet printing apparatuses, there has been a growing demand for the improved quality of printed images and improved functions such as faster printing. To improve the quality of printed images, the size of dots can be reduced by decreasing the size of the electrothermal converters and thus the amount of ink per dot. For the dot size, the size of droplets tends to be decreased in order to reduce the granularity of a half tone portion of a gray scale and a half tone portion and a high light portion of a color photo image. In particular, the amount of ink droplets provided by a print head that ejects color ink tend to decrease year by year from about 5 pl to 2 or 1 pl. Furthermore, evolution and prevalence of digital input apparatuses has resulted in a strong demand for high-definition images such as photographic images. As a result, the size of ink droplets is desired to be further reduced.

The increasingly reduced size of ink droplets serves to improve the quality of images for which a high contrast such as that of photographic images is required. However, if characters are printed, the reduced size of ink droplets may reduce printing speed. To avoid this problem, for example, the same print head comprises nozzles and electrothermal converters which allow larger ink droplets are ejected, and nozzles and electrothermal converters which allow smaller ink droplets to be ejected. That is, the former nozzles and electrothermal converters are used to eject the larger ink droplets in order to print characters and the like, whereas the latter nozzles and electrothermal converters are used to eject the smaller ink droplets in order to print high-quality images. Thus, both high image quality and appropriate printing speed can be achieved by using the different nozzles and electrothermal converters to selectively eject the larger or smaller ink droplets.

However, if the size of electric resistors constituting the electrothermal converters is reduced so as to correspond to the reduced size of ink droplets, the electric resistors (heating resistors) need to have an increased electric resistance value so as to be driven under the same driving conditions as those in the conventional art.

With reference to FIGS. 16A, 16B, and 16C, description will be given of the relationship between the size of heating resistors constituting electrothermal converters and the driving conditions for the heating resistors. A large-sized heating resistor A and a small-sized heating resistor B were prepared as shown in FIG. 16A. FIG. 16B shows variations in the resistance values (solid lines A and B) and current values (dotted lines A and B) of the heating resistors A and B with respect to driving pulse width which variations are observed when a fixed driving voltage is used for the heating resistors A and B. FIG. 16C shows variations in the resistance values (solid lines A and B) and current values (dotted lines A and B) of the heating resistors A and B with respect to the driving voltage which variations are observed when a fixed driving pulse width is used for the heating resistors A and B. As is apparent from FIGS. 16B and 16C, with the reduced size of the heating resistor, the resistance value needs to be increased in order to allow the hating resistor to be driven under the same conditions as those in the conventional art.

Japanese Patent Laid-Open No. 10-114071 describes an ink jet print head in which each of the heating resistors is composed of a thin film to provide a high heating resistance characteristic corresponding to the reduced size of ink droplets. The heating resistor is made up of a thin film of TaxSiyNz in which x=20 to 80 at %, y=3 to 25 at %, and z=10 to 60 at %.

As described above, the resistance of the heating resistor can be effectively increased in order to reduce the size of ink droplets. On the other hand, the increased resistance of the heating resistor makes the adverse effect of the film formation tolerance of the heating resistor more serious. As a result, in the same nozzle row with a plurality of nozzles arranged therein, the film formation tolerance of the electrothermal resistors corresponding to the respective nozzles may vary bubbling energy generated by the electrothermal resistors. In this case, the amount of ink ejected may vary among the nozzles in the same nozzle row, degrading the quality of high-definition images.

Furthermore, ink ejection speed may vary among the nozzles in the same nozzle row, causing ink droplets to impact a print medium at incorrect positions. This may degrade the quality of high-definition images. Further, if the bubbling energy varies among the electrothermal resistors corresponding to the respective nozzles in the same nozzle row, energy of a magnitude equal to or larger than a set value is applied to the heating resistors. Thus, the heating resistors may be disconnected before meeting the predetermined number of required ink ejections.

Furthermore, in order to allow the larger and smaller ink droplets to be ejected from the print head, large- and small-sized heating resistors (heaters) need to be provided so as to provide different amounts of ink droplets ejected. In order to drive small-sized heating resistors using the same driving voltage as that for conventional large-sized heating resistors, it is necessary to increase the resistance value of the small-sized heating resistors or to reduce the driving pulse width. Thus, in order to drive the heating resistors of different sizes mixed in the same print head, it is necessary to provide the heating resistors with different resistance values or to drive the heating resistors using different driving pulses of respective pulse widths.

For example, if a large-sized heating resistor allowing 5 pl of ink droplets to be ejected is driven using a driving pulse of pulse width 0.8 μs, a small-sized heating resistor allowing 2 pl of ink droplets to be ejected must be driven using a driving pulse of pulse width 0.4 μs. It is conventionally known that a pulse width of at most 0.6 μs results in unstable ink ejection, affecting the use of the print head in a normal environment. That is, it is difficult to drive heating resistors of different sizes using driving pulses of different pulse widths.

On the other hand, to provide heating resistors of different sizes with respective resistance values, it is possible to vary the shape or the sheet resistance value (resistance value per unit area) among the heating resistors.

With a print head that ejects larger and smaller ink droplets, if the same driving voltage is used for both the heating resistor allowing the larger ink droplets to be ejected and the heating resistor allowing the smaller ink droplets to be ejected, the same sheet resistance value (resistance value of the heating resistor per unit area) is conventionally used on the same substrate in the print head. Thus, if one of the large- and small-sized heating resistors is substantially square, the other heating resistor must be rectangular. For the print head, the heating resistor located immediately below (downstream of) the ejection port is ideally square. If the heating resistors are not symmetric with respect to the ejection port, an adverse effect may be exerted on the ejection angle of main ink droplets ejected from the ejection port and on the bending of satellite droplets ejected after the main droplets. This may reduce the accuracy with which ink droplets impact the print medium as well as the print quality.

Furthermore, if the heating resistor allowing the larger ink droplets to be ejected and the heating resistor allowing the smaller ink droplets to be ejected each have an ideal square shape, different driving voltages must be set for the respective heating resistors. This results in the need for one more power supply unit, increasing the costs of the ink jet printing apparatus main body.

Different wiring resistors may be connected to the heating resistor allowing the larger ink droplets to be ejected and the heating resistor allowing the smaller ink droplets to be ejected, in order to provide each of the heating resistors with an ideal square shape and to allow the same driving voltage to be used for both heating resistors. However, this may pose problems such as too small a wiring width and a significant variation in wiring resistance.

SUMMARY OF THE INVENTION

The present invention provides an ink jet print head that enables an optimum resistance value to be set for a heating resistor that generates ink ejection energy to allow high-quality images to be printed, as well as a method for manufacturing the ink jet print head.

In the first aspect of the present invention, there is provided an ink jet print head that is able to eject an ink droplet utilizing heat generated by a heating resistor, the ink jet print head comprising: first and second heating resistors formed, as the heating resistor, on the same substrate, each of the first and second heating resistors being made of a material having a sheet resistance value which is able to be varied depending on energy provided by an anneal process, wherein sheet resistance values of the first and second heating resistors are set at different values by adjusting the sheet resistance value of at least one of the first and second heating resistors by the anneal process.

In the second aspect of the present invention, there is provided a method for manufacturing an ink jet print head that is able to eject an ink droplet utilizing heat generated by a heating resistor, the method comprising the steps of: forming, as the heating resistor, first and second heating resistors on the same substrate, each of the first and second heating resistors being made of a material having a sheet resistance value able to be varied depending on energy provided by an anneal process; and adjusting sheet resistance value of at least one of the first and second heating resistors by the anneal process so that the sheet resistance values of the first and second heating resistors are set at different values.

According to the present invention, as a heating resistor generating ink ejection energy, the first and second heating resistors of the different sheet resistance values are formed on the same substrate. This allows the resistance of each of the heating resistors to be set at the optimum value in accordance with the sheet resistance value. As a result, the ink ejection amount and ejection speed can be set at the optimum values to allow high-quality images to be printed.

Further features of the present invention will become apparent from the following description of exemplary embodiments (with reference to the attached drawings).

DESCRIPTION OF THE EMBODIMENTS

Embodiments of the present invention will be described below in detail with reference to the drawings. However, the present invention is not limited to the embodiments described below. Any embodiment may be used provided that the embodiment can achieve the object of the present invention.

First Embodiment

FIGS. 1 to 9 are diagrams illustrating a first embodiment of the present invention. Separate descriptions will be given of the general configuration of a printing apparatus, the general configuration of a print head cartridge, the general configuration of a heating resistor, the specific configuration of a print head portion, the circuit configuration of a print head base, and a method for producing the heating resistor.

<General Configuration of the Printing Apparatus>

Figure 1:
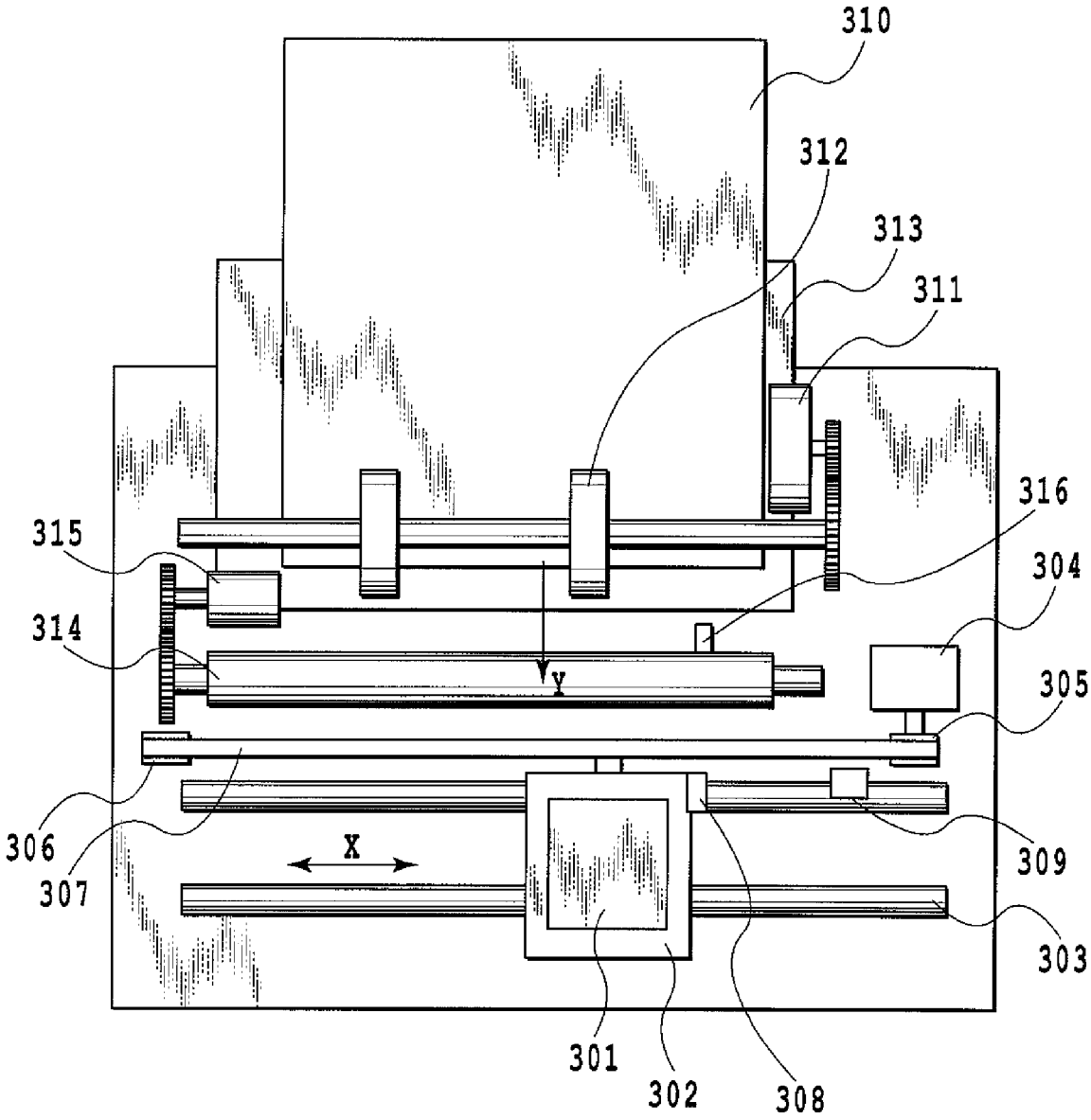
FIG. 1 is a schematic diagram of the configuration of a printing apparatus in which an ink jet print head in accordance with a first embodiment of the present invention can be mounted.

FIG. 1 is a schematic plan view of an ink jet printing apparatus to which the present invention is applicable. A print head cartridge 301 is replaceably mounted on a carriage 302. The print head cartridge 301 is what is called a cartridge type print head having a print head portion and an ink tank portion. The print head cartridge 301 has a connector (not shown) that receives a driving signal for the head portion and the like. The print head cartridge 301 is replaceably mounted on the carriage 302. The carriage 302 has a connector holder (electric connection portion) that allows the driving signal and the like to be transmitted to the print head cartridge 301 via the connector.

The printing apparatus main body has a guide shaft 303 installed therein and extending in a main scanning direction shown by arrow X. The carriage 302 is guided so that the carriage 302 can reciprocate in the main scanning direction along the guide shaft 303. The carriage 302 is driven by the driving force of a main scanning motor 304 via a driving mechanism such as a timing belt 307 provided between a motor pulley 305 and a follower pulley 306 so as to have the movement position thereof controlled. The carriage 302 also has a home position sensor 308. A shield plate 309 is provided at a specified position in the printing apparatus main body. The home position sensor 308 on the carriage 302 passes by the position of the shield plate 309 to detect the shield plate 309. The position of the carriage 302 can then be determined on the basis of the position at which the home position sensor 308 has detected the shield plate 309.

Rotation of a pickup roller 312 by a sheet feeding motor 311 via a gear allows each print medium 310 such as a print sheet or a thin plastic sheet to be separately fed from an auto sheet feeder (hereinafter referred to as an "ASF") 313. Rotation of a conveying roller 314 further conveys the print medium 310 in a sub-scanning direction shown by arrow Y through a position (print portion) opposite to an ejection port surface of the print head cartridge 301. The conveying roller 314 is rotated by a sub-scanning motor 315 via a gear. In this case, determination of whether or not the print medium 310 has been fed and determination of a print start position on the print medium 310 during sheet conveying are performed when a leading end of the print medium 310 having passed by the position of a paper end sensor 316 is detected. The paper end sensor 316 is also used to determine the position of an end portion of the print medium 310 and to determine the current print position on the print medium 310 on the basis of the position of the end portion.

To form a flat print surface in the print portion, the print medium 310 has its back surface supported by a platen. The print head cartridge 301, mounted on the carriage 302 and having an ejection port forming surface (ejection port surface) projecting downward from the carriage 302, is held parallel to the surface of the print medium 310.

The print head cartridge 301 is based on an ink jet scheme of ejecting ink utilizing thermal energy and comprises heating resistors as electrothermal converters (heaters) for generating thermal energy. That is, a print head portion of the print head cartridge 301 uses thermal energy generated by the heating resistors to cause film boiling so that the resulting bubble pressure can be utilized to eject ink from the ejection ports.

Figure 2:
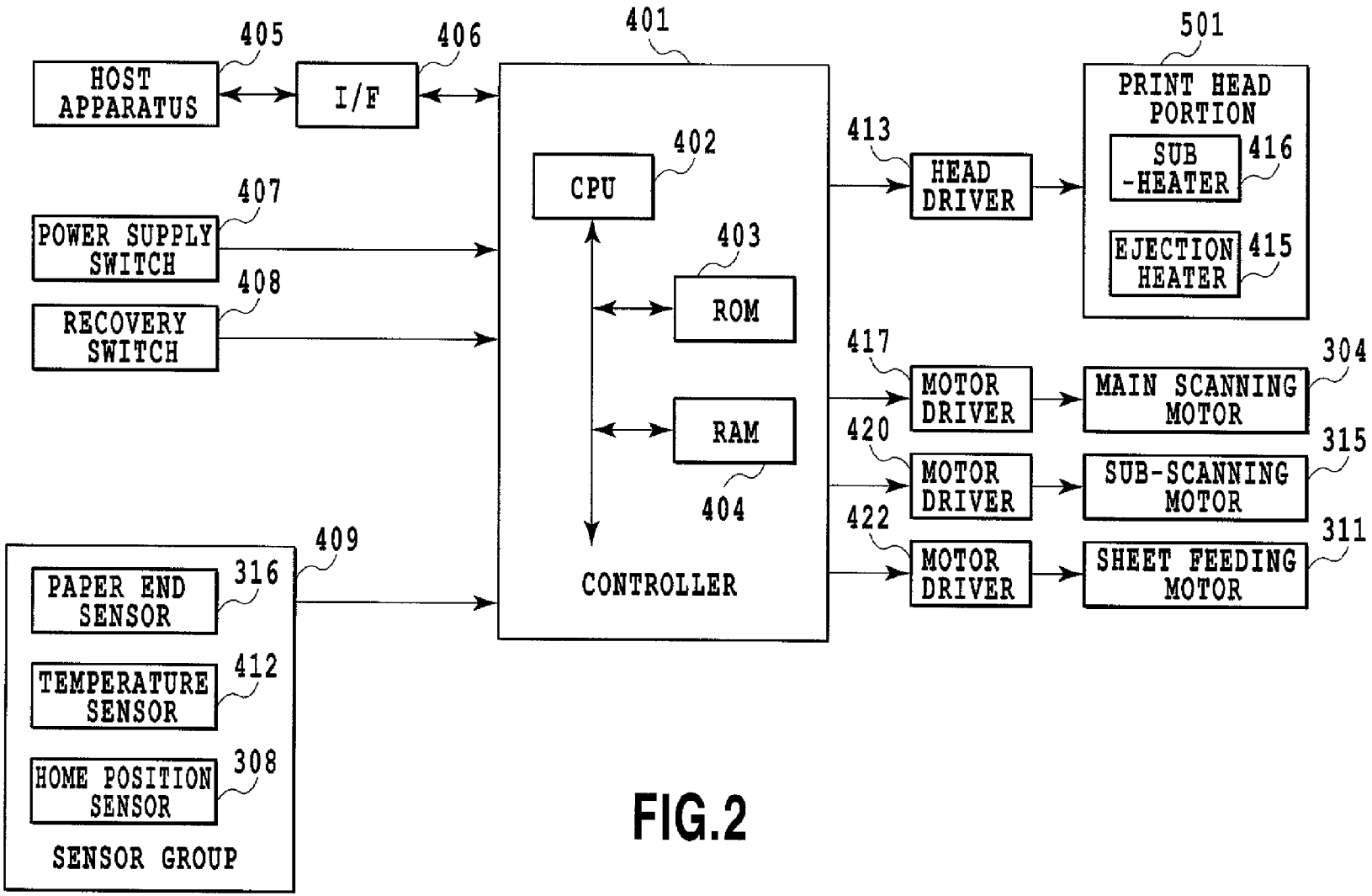
FIG. 2 is a block diagram of a control system for the printing apparatus in FIG. 1.

FIG. 2 shows the block configuration of a control system for the ink jet printing apparatus in FIG. 1.

In the figure, a controller 401 is a main control section having, for example, a CPU 402 in microcomputer form, a ROM 403, and a RAM 404. The ROM 403 stores programs, required tables, and other fixed data. The RAM 404 has an area in which image data is decompressed, a work area, and the like. A host apparatus 405 is a source of image data and may be in the form of a computer which creates data such as images to be printed and which executes processes and the like, or a reader section for reading images. Image data, commands, status signals, and the like are transmitted between the controller 401 and the host apparatus 405 via an interface (I/F) 406.

A group of switches including a power supply switch 407 and a recovery switch 408 for instructing the apparatus to start a suction recovery operation receives instructions input by an operator. The suction recovery operation sucks and discharges ink not contributing to image printing from the ejection ports in the print head portion in order to properly maintain the state of ejection of ink from the print head portion.

A sensor group 409 detects the state of the printing apparatus. The sensor group 409 includes not only the home position sensor 308 and paper end sensor 316, described above, but also a temperature sensor 412 provided at an appropriate position to detect environmental temperature.

A head driver 413 drives a plurality of ejection heaters (electrothermal converters) 415 for ink ejection provided in a print head portion 501 of the print head cartridge 301. The head driver 413 comprises a shift register, a latch circuit, a logic circuit element, and a timing setting section. The shift register aligns print data in association with the positions of the ejection heaters 415. The latch circuit latches the print data at appropriate timings. The logic circuit element activates the ejection heaters in synchronism with a driving timing signal. The timing setting section appropriately sets driving timings (ejection timings) to adjust dot forming positions.

The print head portion 501 has sub-heaters (electrothermal converters) 416. The sub-heaters 416 adjust temperature in order to stabilize the ejection properties of the ink. The sub-heaters 416 may be formed on the substrate in the print head portion 501 simultaneously with the ejection heaters 415 or mounted on the print head cartridge 301.

A motor driver 417 drives the main scanning roller 304. A motor driver 420 drives the sub-scanning motor 315. A motor driver 422 drives the sheet feeding motor 311.

<General Configuration of the Print Head Cartridge>

Figure 3:
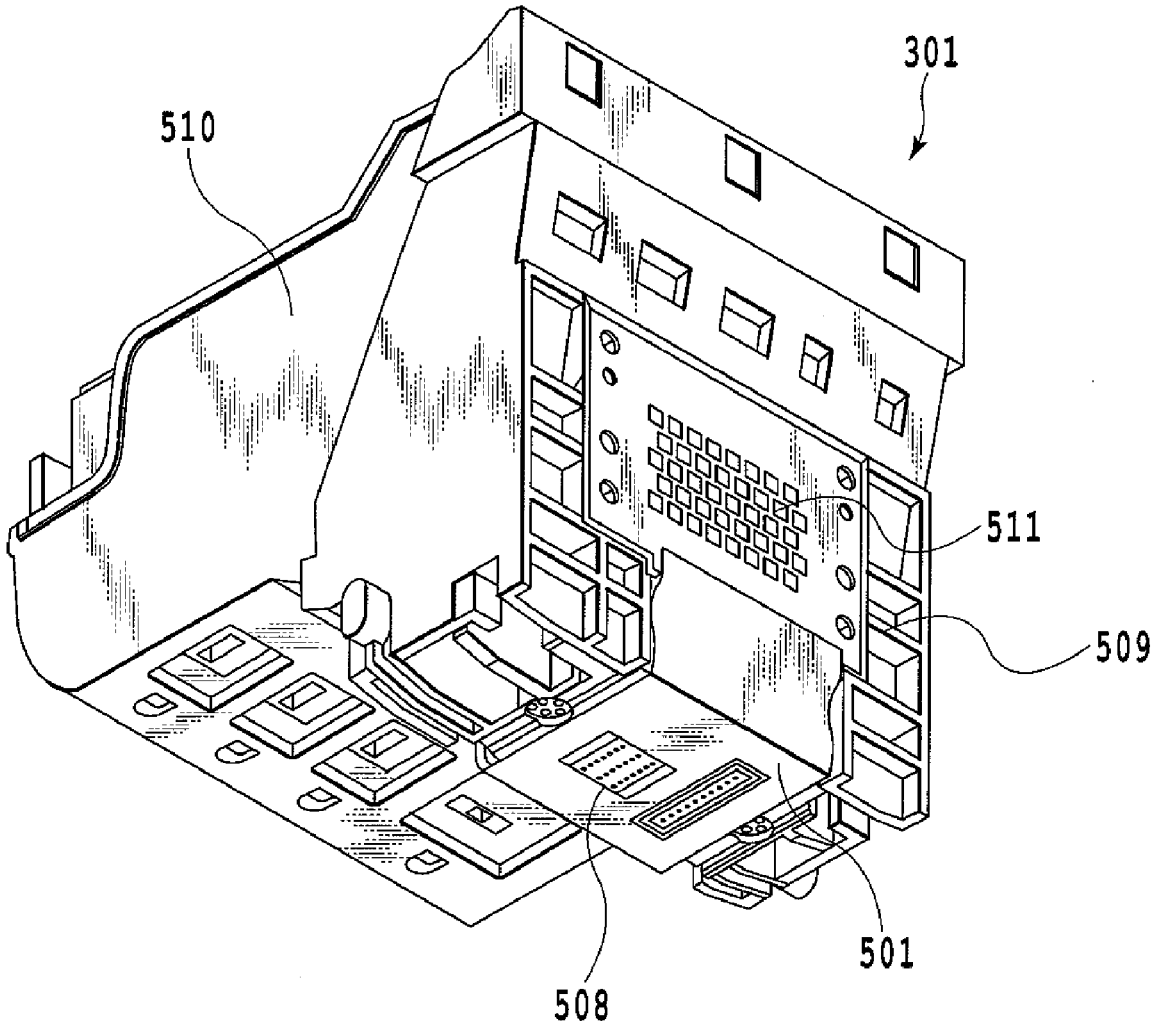
FIG. 3 is a perspective view of the ink jet print head in accordance with the first embodiment of the present invention as viewed from a print element substrate.
Figure 4:
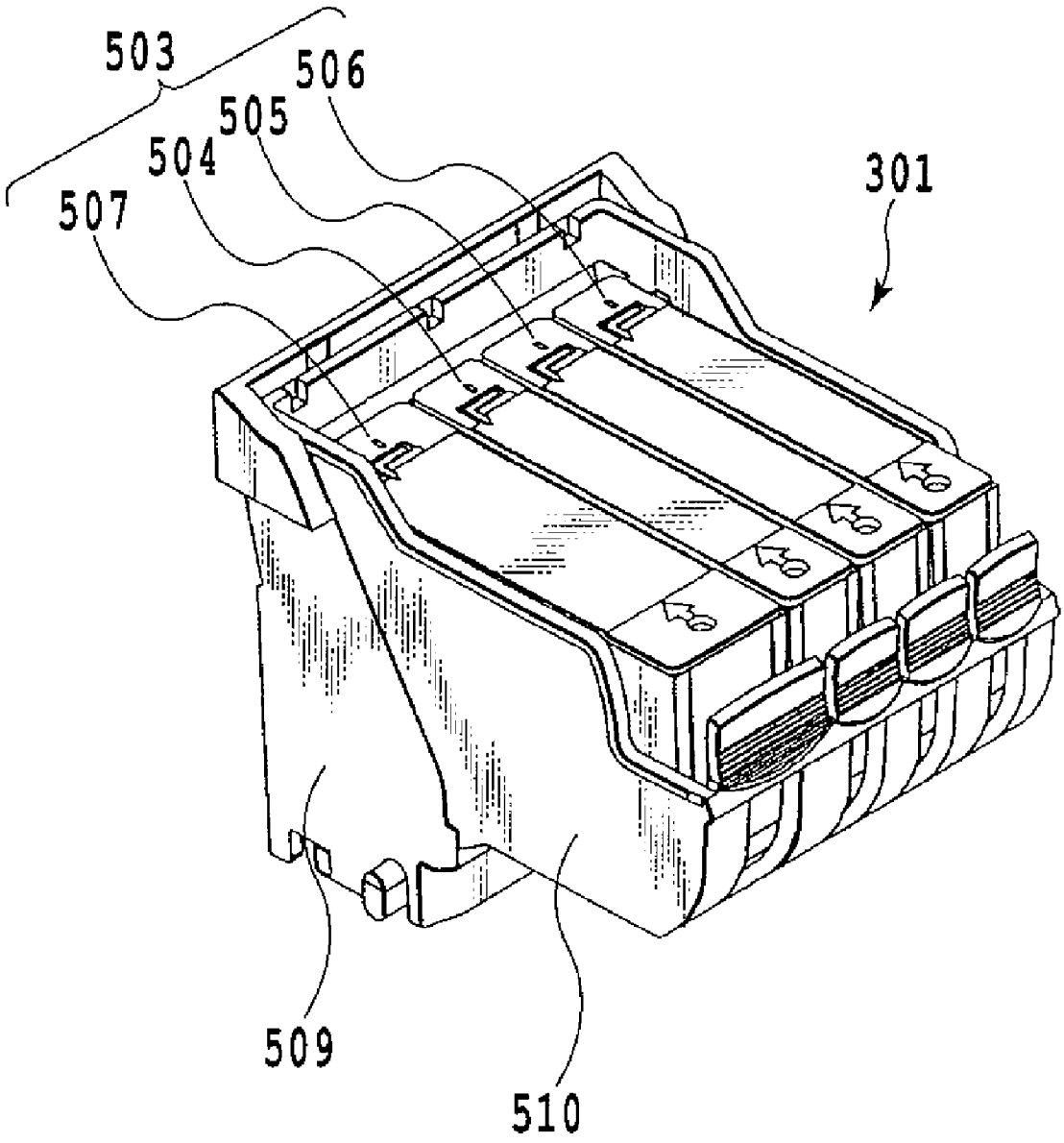
FIG. 4 is a perspective view of the ink jet print head in FIG. 3 as viewed from an ink tank.

FIGS. 3 and 4 are diagrams illustrating an example of the configuration of the head cartridge 301, to which the present invention is applicable. The figures show the print head portion, the ink tank portion holding the ink (liquid), and the relationship between the print head portion and the ink tank portion.

The print head cartridge 301 in the present example includes the print head portion 501 and an ink tank 503 releasably provided in the print head portion 501. As shown in FIG. 1, the print head cartridge 301 can be released from the carriage 302 in the printing apparatus. The print head cartridge 301 is positioned on the carriage 302 by positioning means (not shown) and contacts electric contacts (not shown) for electric connections.

The ink tank 503 includes four ink tanks, an ink tank 504 for cyan ink, an ink tank 505 for magenta ink, an ink tank 506 for yellow ink, and an ink tank 507 for black ink. The ink tanks 504, 505, 506, and 507 can be independently released from the print head portion 501 and individually replaced with new ones. This configuration enables the ink tank 503 to be appropriately replaced with a new one for efficient use, allowing a reduction in the running costs of the printing apparatus.

The print head mounted in the print head portion 501 is based on the ink jet scheme and uses the electrothermal converters (heating resistors) that generate thermal energy in order to subject the ink to film boiling in response to an electric signal as described above.

The print head portion 501 includes a print element unit 508, an ink supply unit (liquid supply unit) 509, and a tank holder 510. The print element unit 508 includes a print element circuit, a plate, an electric wiring tape (electric wiring substrate), and an electric contact substrate. The ink supply unit 509 includes an ink supply member, a channel forming member, a joint seal member, a filter, and seal rubber.

In the print element unit 508, the plate is formed of, for example, an alumina ($Al_2O_3$) material of thickness 0.5 to 10 mm. The material of the plate is not limited to the alumina, but any other material may be used which has a coefficient of linear expansion equivalent to that of the material of the print element substrate and has a thermal conductivity equivalent to or higher than that of the material of the print element substrate. The print element substrate, for example, a Si substrate of thickness 0.5 to 1 mm, has ink supply ports, long groove-like through-holes, formed therein and serving as ink channels. A row of plural heating resistors serving as electrothermal converters (heaters) are arranged on each side of the ink supply ports. Electric wires made of Al or the like are also formed on each side of the ink supply ports to supply power to the heating resistors. The heating resistors and the electric wires are formed by a film forming technique. The heating resistors are staggered as described below. For example, the two ejection port rows in each of which the plurality of ejection ports are arranged so as to prevent each of the ejection ports in one of the rows and the corresponding ejection port in the other row from being arranged orthogonally to the arrangement direction. An electrode portion is formed along an outer side of the heating resistors to supply power to the electric wires. Bumps made of Au or the like are formed on the electrode portion.

A structure made of a resin material is formed on the Si substrate by photolithography. The structure has an ink channel wall and a ceiling portion covering the top of the ink channel wall, in order to form ink channels corresponding to the heating resistors (heaters), with the plurality of ejection ports formed in the ceiling portion. The plurality of ejection ports are formed opposite the respective heating resistors to form the ejection port rows. The ink channel, the heating resistor, and the ejection port constitute the print element. When heated by the heating resistor, ink fed through the ink channel bubbles. The resulting bubbling energy is then utilized to eject the ink from the ejection port located opposite the heating resistor.

An ink supply member is a component of the ink supply unit 509 which allows the ink to be guided from the ink tank 503 to the print element unit 508. The ink supply member is formed by, for example, molding resin. The resin material is desirably mixed with 5 to 40% of glass filler to improve form rigidity. The ink supply member and the tank holder 510 form an accommodating portion that releasably accommodates the ink tank 530. A tank positioning hole is formed at the bottom of the accommodating portion to engage with a tank positioning pin on the ink tank 503. A hole is formed in a rear wall of the accommodating portion to engage with a pawl on the ink tank 503. A movable lever is provided in the front of the ink tank 503 and has the pawl formed thereon and engaging with the wall of the accommodating portion. Applying a force to the lever for elastic deformation allows the ink tank 503 to be removed. The ink supply member has the hole formed therein and engaging with the pawl on the ink tank 503. The ink supply member thus constitutes a part of the means for holding the releasable ink tank 503.

The print head unit 508 and the ink supply unit 509 are combined together via a joint seal member by screws. The joint seal member has holes formed at positions corresponding to the ink supply ports in the plate and ink introduction ports in a channel forming member. The joint seal member is made of an elastic material such as rubber which is unlikely to undergo compression set. The print head unit 508 and the ink supply port 509 are contacted with each other under pressure via the joint seal member to allow the ink supply ports to communicate properly with the ink introduction ports while preventing possible ink leakage.

The electric contact substrate 511 of the print element unit 508 is positioned on and fixed to a rear surface of the ink supply member. The two terminal positioning pins provided at the respective positions on the rear surface of the ink supply unit 509 are passed through the terminal positioning holes in the electric contact substrate 511 to position the electric contact substrate 511. That is, the electric contact substrate 511 is fixed by passing the terminal combining pin of the ink supply unit 509 through the terminal combining holes and tightening the terminal combining pins. The method of fixing the electric contact substrate 511 is not limited to this and other fixing means may be used.

The print head cartridge 301 is constructed by combining the ink supply unit 509 with the print element unit 508 and further combining the ink supply member with the tank holder 510.

<General Configuration of the Heating Resistor>

Each of the heating resistor in the print head portion 501, serving as an electrothermal converter, is formed of a heating-resistor thin film. The heating-resistor thin film has microcrystal areas scattered in a CrSiN amorphous film (amorphous film made of Cr, Si, and N) and made of a Cr and Si composition (made of Cr and Si) as described below. The microcrystal is composed of a crystal made of one of $Cr_3Si$, CrSi, $CrSi_2$, and $Cr_5Si_3$, or plural types of Cr and Si. The film of the heating resistor is formed by reactive sputtering using an alloy target made of Cr and Si.

In the present example, the heating resistor film is produced by reactive sputtering under various film forming conditions. The anneal process is then executed to stabilize the properties of the heating resistor film. The anneal process is executed by varying a short-pulse voltage so as to control the energy amount in accordance with the varying resistance value of the heating resistor, applying a fixed number of pulses to the heating resistor.

With the film forming method, immediately after the film formation, a CrSiN thin film is formed as an amorphous film. The above short pulse is applied to the CrSiN thin film to execute the anneal process to form a CrSi microcrystal made of Cr and Si in the CrSiN film (film made of Cr, Si, and N), which is amorphous during the thin film formation. This results in a crystallographically stable structure. That is, the anneal process effectively forms a intermetallic compound made of $Cr_3Si$, CrSi, $Cr_2Si_2$, $Cr_5Si_3$, or the like in the CrSiN film, which has been amorphous since the thin film formation. As a result, the CrSiN film in the heating resistor forms a stable crystalline structure.

The temperature for the thermal treatment for forming the microcrystal area made of Cr and Si in the CrSiN thin film is desirably higher than the highest temperature reached when the CrSiN film is actually driven as a heating resistor. However, when the thermal treatment temperature is at least 800° C., the microcrystal made of Cr and Si has a particle size of at least 10 nm. Then, during the subsequent actual driving, strain may occur between the microcrystal and surrounding crystals. This may cause electric disconnection, degrading the durability of the print head portion 501. The number of SiN bonds around the periphery of the microcrystal made of Cr and Si may increase to increase the resistance value of the heating resistor itself. The resistance value may thus fall out of a stable area.

Furthermore, the thermal treatment can be achieved in a short time by applying a short-pulse voltage to the heating resistor to instantaneously increase the temperature as is the case with the scheme of driving the heating resistor. This is effective for the print head portion 501 in which wiring electrodes are formed of an Al alloy or the like, that is, the configuration on which the desired thermal treatment cannot be executed, as described above. When the driving voltage is thus applied to the heating resistor, the driving frequency is preferably 0.5 to 30 kHz, more preferably 1 to 20 kHz. The driving voltage preferably has a pulse width of 0.1 to 100 μsec, more preferably 0.5 to 10 μsec. The applied voltage is preferably 1.1 to 1.8 times, more preferably 1.3 to 1.7 times as high as a voltage Vth applied to start the ink bubbling. Although depending on the applied voltage, the number of pulses is preferably 10 to 10,000, more preferably 100 to 10,000. By applying a short-pulse voltage to the heating resistor so as to control the supplied energy, it is possible to effectively form a microcrystal area having the desired particle size in a shorter time.

In general, an Al alloy is used as an electrode material (constituting a metal wiring layer) required to provide energy to the heating resistor. The electrode material is often formed into an upper layer and a lower layer for the heating resistor CrSiN film. A thermal treatment at 800° C. or higher may grow the Al alloy into whiskers to short-circuit the wires, reducing yield. Moreover, the Al alloy itself may be softened and deformed.

In the present example, even in this case, a short-pulse voltage is applied to the heating resistor to enable the thermal treatment to be performed after the heating-resistor thin film has been formed. In the present example, the amount of energy applied to the heating resistor is controlled in accordance with the varying resistance value of the CrSiN film. This enables the anneal state of the finally required heating resistor to be stabilized.

Figure 5:
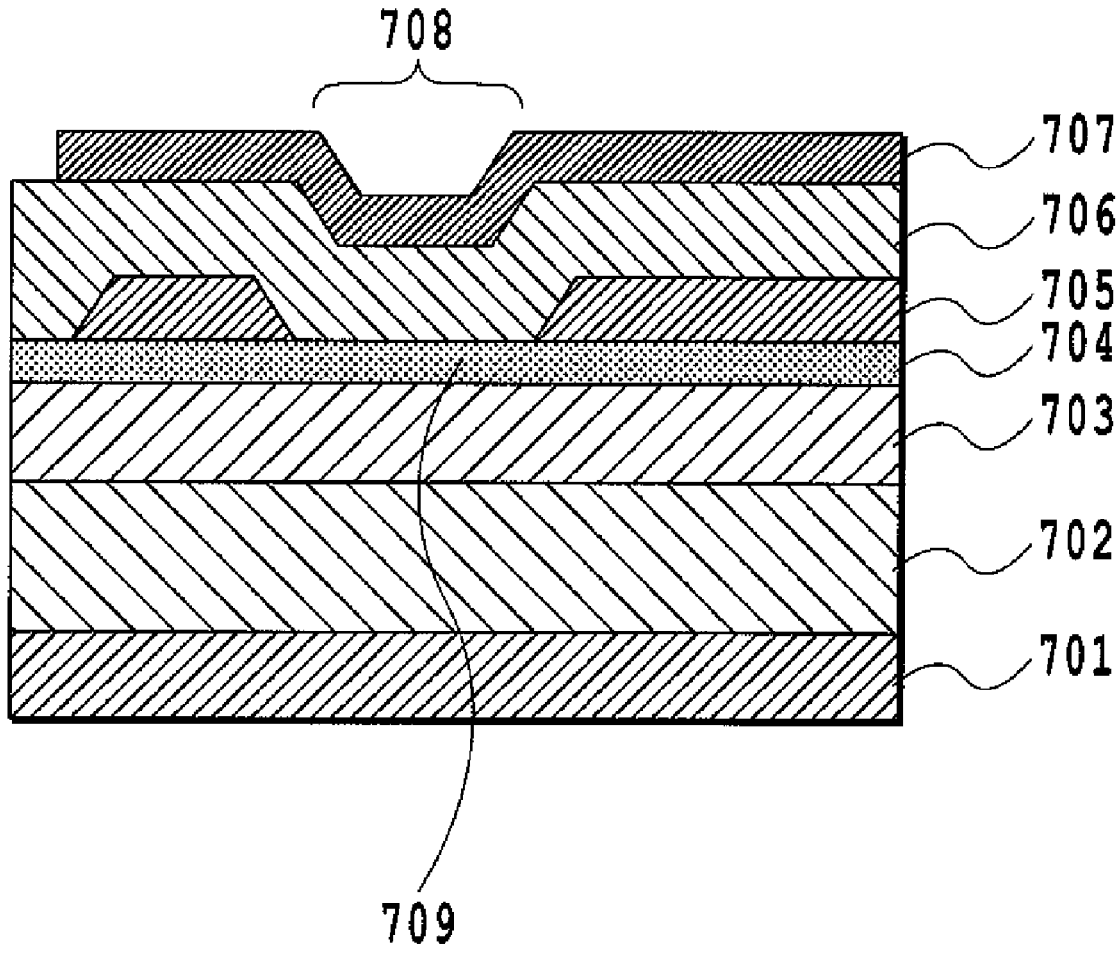
FIG. 5 is an enlarged sectional view of an essential part of the ink jet print head in FIG. 3.

FIG. 5 is a sectional view of the print element substrate. As described below, microcrystal areas 709 made of Cr and Si are scattered in a heating resistant layer (CrSiN film) 704 forming the heating resistor. The microcrystal areas 709 are each 1 nm to 10 nm in a long side direction and scattered in the heating resistant layer (CrSiN film) 704. Microcrystal particles preferably have a particle size of 1 to 3 nm. The size of the microcrystal particle depends on a thermal treatment temperature and is observed by analyzing the cross section of the heating resistor using an analysis apparatus such as a TEM.

In the print head portion in the present example, the ink ejection ports and the ink channels can be formed by a well-known form processing method such as etching. In the print element substrate, the layers other than the heating resistor can be formed by a well-known film forming method. For example, a thermal storage layer 702 is formed by thermally oxidizing a silicon substrate 701. The other layers (an interlayer film 703, the heating resistant layer 704, a protective layer 706, and a cavitation resistant layer 707) can be formed by CVD, sputtering, or evaporation. A thermal action portion 708 can be similarly formed by a well-known form processing method.

<Specific Configuration of the Print Head Portion>

Figure 6:
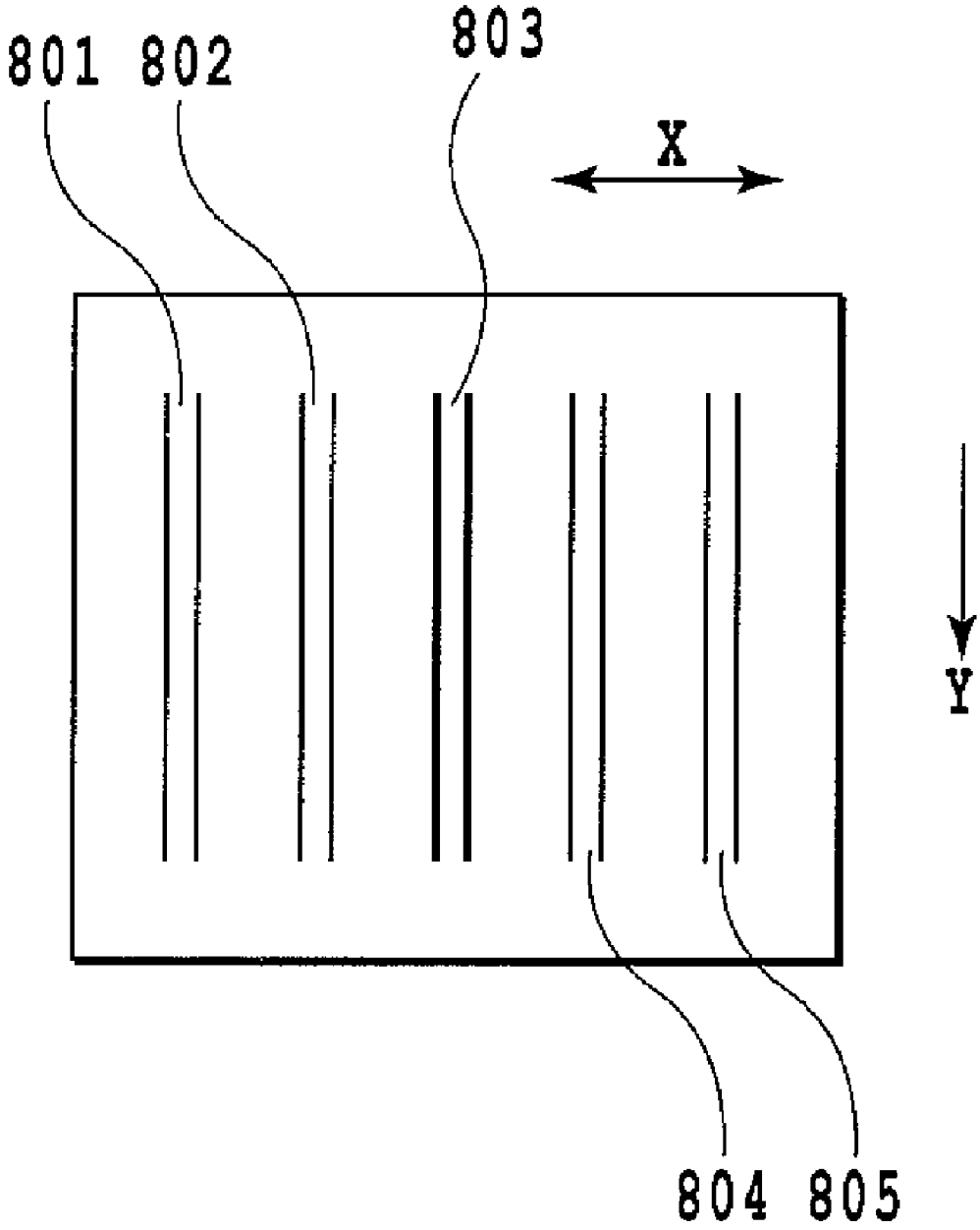
FIG. 6 is a diagram illustrating a nozzle portion of the ink jet print head in FIG. 3.
Figure 7:
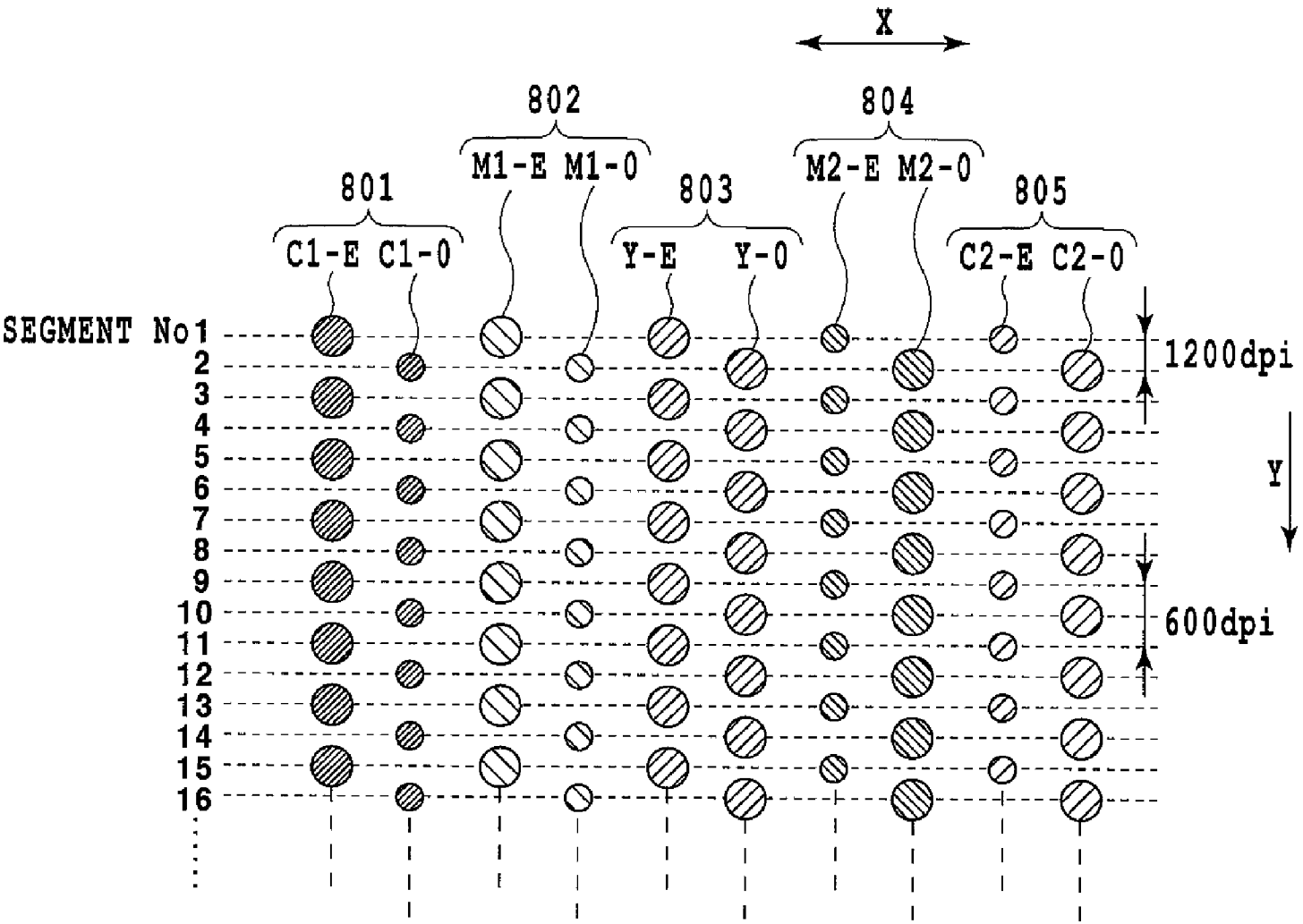
FIG. 7 is an enlarged diagram of the nozzle portion of the ink jet print head in FIG. 3.

The print head portion 501 in the present example is provided with a first nozzle group 801 and a second nozzle group 805 for ejection of cyan ink, a first nozzle group 802 and a second nozzle group 804 for ejection of magenta ink, and a nozzle group 803 for ejection of yellow ink as shown in FIGS. 6 and 7.

The first nozzle group 801 for the cyan ink and the first nozzle group 802 for the magenta ink are positioned on one side (the left of FIG. 7) of the nozzle group 803 for the yellow ink. The second nozzle group 805 for the cyan ink and the second nozzle group 804 for the magenta ink are positioned on the other side (the right of FIG. 7) of the nozzle group 803 for the yellow ink. Thus, the nozzle groups for each ink color are provided symmetrically in the main scanning direction, shown by arrow X. This is effective for bidirectional printing that prints images by ejecting the ink while the print head cartridge is moving forward and backward. That is, the order in which the cyan ink, magenta ink, and yellow ink are ejected during the printing in the forward direction can be set the same as that in which the cyan ink, magenta ink, and yellow ink are ejected during the printing in the backward direction. This makes it possible to prevent a possible nonuniform color in an image printed by mixing the color inks (for example, a gray image printed by ejecting red ink, blue ink, green ink, and the three color inks to the print medium).

Nozzle rows C1-E and C2-O are an odd row and an even row from which 5 pl of cyan ink is ejected. Nozzle rows C1-O and C2-E are an odd row and an even row from which 2 pl of cyan ink is ejected. Nozzle rows M1-E and M2-O are an odd row and an even row from which 5 pl of magenta ink is ejected. Nozzle rows M1-O and M2-E are an odd row and an even row from which 2 pl of magenta ink is ejected. Nozzle rows Y-E and Y-O are an odd row and an even row from which 5 pl of yellow ink is ejected. Each of the nozzle rows include 256 nozzles arranged at 600 dpi (dots/inch).

Thus, the print resolution in the sub-scanning direction for one nozzle row is 600 dpi, and nozzle rows with the same color and the same ejection amount are offset from each other by 1200 dpi in the sub-scanning direction. This results in a print resolution of 1,200 dpi in the sub-scanning direction. In the present example, a driving voltage and a driving frequency for the print head portion 501 are 24 V and 15 KHz, respectively. The movement speed of the carriage 302 is 25 inches/sec. The print head portion 501 performs printing at a resolution of 1,200 dpi in the main scanning direction.

<Circuit Configuration of the Print Head Base>

Figure 8:
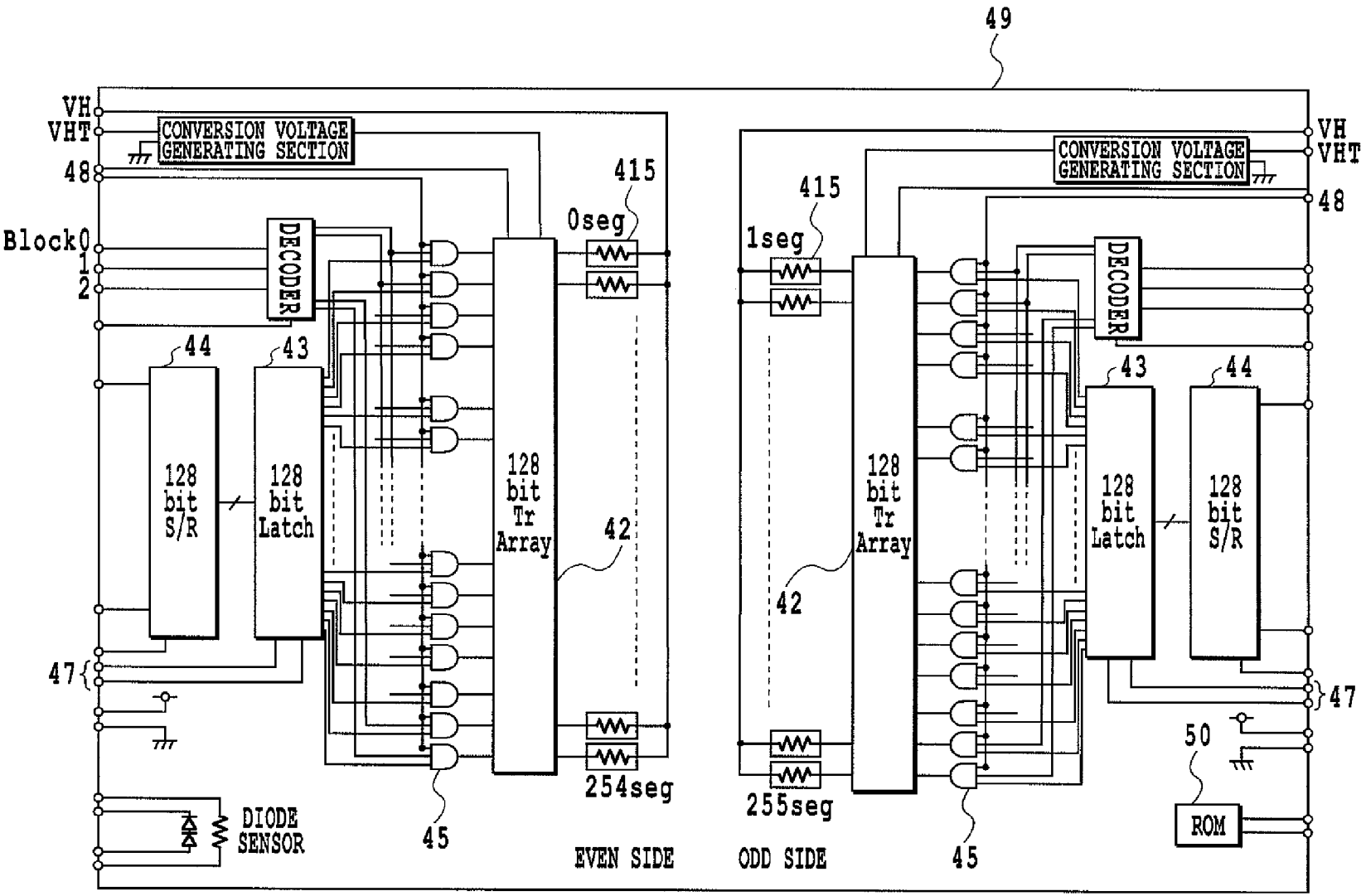
FIG. 8 is a diagram illustrating the configuration of a circuit provided in the ink jet print head in FIG. 3.

FIG. 8 is a diagram illustrating a driving circuit for the nozzle rows C1-O and C2-E or a driving circuit the nozzle rows M1-O and M2-E. The driving circuits are constructed on a print head base.

In FIG. 8, reference numeral 49 denotes a base for the print head portion, and reference numeral 43 denotes a latch circuit that latches print data. Reference numeral 44 denotes a shift register to which the print data is serially input in synchronism with a shift clock. Reference numeral 47 denotes an input terminal for a latch signal that allows the print data input by a control section of the printing apparatus to be latched. Reference numeral 48 denotes an input terminal for a heat pulse signal. Select data to be stored in the ROM 50 is serially input to the shift register 44, which thus holds the data. The latch circuit 43 latches the select data.

Each of plural AND circuits 45 calculates the logical OR of the heat pulse signal, the print data signal, a block signal, and the select data. When an output from the AND circuit 45 changes to a high level, a corresponding heating resistor driving transistor in a transistor array 42 is turned on. Current is then passed through a heating resistor 415 connected to the turned-on transistor and serving as an electrothermal converter (heater). The heating resistor 415 is then driven to generate heat.

The circuit on the thus configured print head base functions as follows.

First, after the printing apparatus is powered on, the pulse width of a heat pulse (including a preheat pulse and a main heat pulse) to be applied to each heating resistor 415 is determined in accordance with an ink bubbling level pre-measured for each base 49. The ink bubbling level is obtained by ranking the minimum pulse required to bubble the ink when a predetermined voltage is applied to the heating resistor 415 under a specified temperature condition. The thus determined heat pulse width data corresponding to each ejection port is transferred to the shift register 44 in synchronism with the shift clock. A voltage signal is subsequently output. Before current is passed through the heating resistor 415, driving conditions for the heating resistor 415 are selected in accordance with the select data stored in the ROM 50.

The select data stored in the ROM 50 is latched in the latch circuit 43. The latching of the select data needs to be executed only once when, for example, the printing apparatus is started.

To generate a heat pulse signal, first, a signal from the ROM 50 is fed back. Then, in accordance with pulse data selected on the basis of the signal, the pulse width of the heat pulse is determined so as to apply energy appropriate for ink ejection to the heating resistor 415. Furthermore, in accordance with a detected value from the temperature sensor 412 (see FIG. 2), the pulse width of a preheat pulse and an application timing for the preheat pulse are determined by the printer control section (controller) 401. Various heat pulses (the main heat pulse and preheat pulse) can be set so that the nozzles have a fixed ink ejection amount even under various temperature conditions.

<Method for Producing the Heating Resistor>

For the conventional print head portion, up to 5% of variation in bubbling energy among the plurality of heating resistors in the same nozzle row is permitted owing to a variation in film thickness during the film formation of the heating resistor or in the size of the heating resistor.

Controlling the anneal process as described above enables the electric resistance value of the heating resistor 415 using the CrSiN film as in the case of the present example to be set at any value. This makes it possible to uniformize the bubbling energy among the plurality of heating resistors in the same nozzle row.

Description will be given of a method for producing heating resistors with different sheet resistances on the same substrate.

In FIG. 5, the thermal storage layer 702 of film thickness 1.8 was formed on the silicon substrate by thermal oxidation. A $SiO_2$ film serving as the interlayer film 703 and also as a thermal storage layer was then formed on the thermal storage layer 702 to a film thickness of 1.2 μm by plasma CVD. A CrSiN film as the heating resistant layer 704 was then formed to a film thickness of 40 nm. At this time, gas flow rate was 60 sccm for an Ar gas and 20 sccm for an N2 gas. Power of 500 W was introduced into a target of 30 at % of Cr and 70 at % of Si. Atmosphere temperature was 200° C., and substrate temperature was 200° C.

An Al—Cu film was formed to a film thickness of 550 nm by sputtering as a metal wire 705 used to allow the thermal action portion 708 to heat the heating resistant layer 704. A pattern was then formed on the metal wire 705 by etching using photolithography. The Al—Cu layer was then removed so as to leave a 15 μm×40 μm portion constituting the heating resistor 415. The thermal action portion 708 was then formed. A SiN film as the protective film 706 was subsequently formed to a film thickness of 1 μm by plasma CVD.

A Ta film as the cavitation resistant layer 707 was formed to a film thickness of 200 nm by sputtering to complete a print head base. The heating resistor 704 had a resistivity of 600Ω/□.

The short-pulse voltage was then applied to the heating resistor (heater) 415 allowing 5 pl of ink to be ejected to execute the anneal process on the heating resistor 415. Conditions for the anneal process included a driving frequency of 15 kHz, an applied pulse width of 1 μsec, and an applied pulse count of 300. The applied voltage had energy that was 1.70 times as high as that of the bubbling start voltage Vth. In this case, application of 300 pulses at a time varies not only the resistance value of the heating resistor 415 but also the energy amount as described above. Thus, 300 pulses, corresponding to the total pulse count, are divided into a plurality of sets. A predetermined number of pulses included in each of the resulting sets are applied to heating resistor 415. The resistance value of the heating resistor is then measured. The applied voltage is then varied depending on a variation in resistance value so as to maintain a fixed energy amount. This was repeated to apply the total number of pulses to the heating resistor. As an example in which a total number of pulses are divided into sets, the 300 pulses were divided into a set of 10 pulses, a set of 20 pulses, a set of 20 pulses, a set of 50 pulses, a set of 100 pulses, and a set of 100 pulses. Every time one of the pulse sets was applied to heating resistor 415, the resistance value of the heating resistor 415 was measured. Application of the pulses was repeated. The reason why the small number of applied pulses and thus the small pulse application intervals were initially used is that the resistance value of the CrSiN film initially varies significantly.

Applying the pulses under these conditions reduced the resistance value of the heating resistor 415. An electric resistivity of 450Ω/□, corresponding to a target value, was finally obtained. Thus, the decrease rate of the resistance value of the heating resistor 415 varies depending on the applied voltage, which is varied by a coefficient by which the bubbling start voltage Vth is multiplied. Therefore, to obtain the desired resistance value, it is possible to estimate the decrease rate of the resistance value and to multiply Vth by the coefficient corresponding to the decrease rate to obtain the applied voltage so that a pulse anneal process can be executed using the applied voltage. In the present example, the anneal process was executed by contacting a probe with the electrode on the unitary print element substrate. However, the anneal process can of course be executed on an undiced wafer form.

Figure 9:
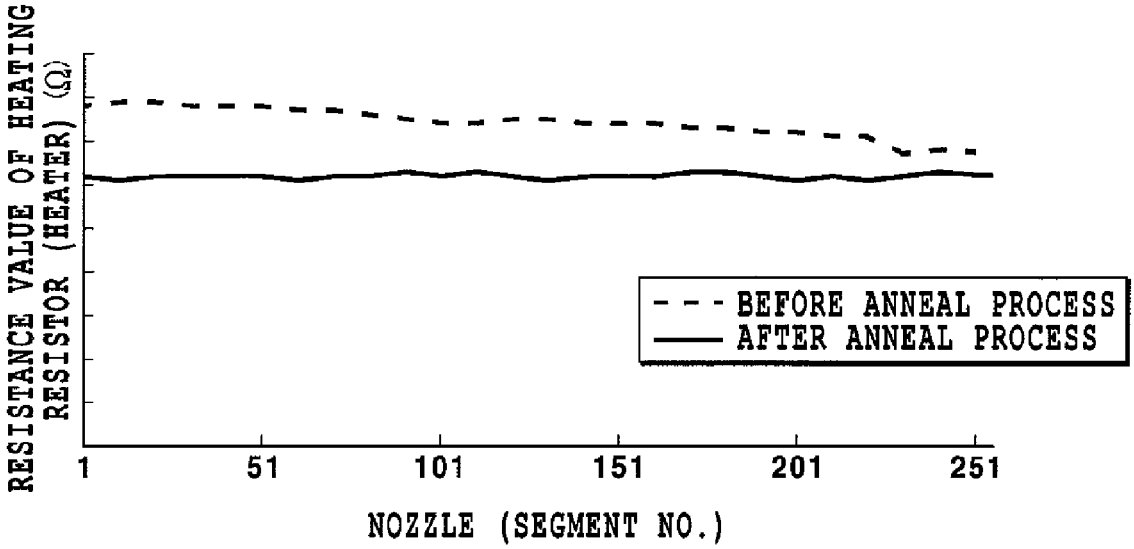
FIG. 9 is a diagram illustrating a variation in electric resistance value observed before and after an anneal process executed on heating resistors in the ink jet print head in FIG. 3.

FIG. 9 shows the results of an operation of variably setting the electric resistance of each of the heating resistors provided in the same nozzle row, at a target value as described above. As is apparent from the figure, the anneal process reduces a variation in initial electric resistance among the heating resistors, resulting in a uniform electric resistance value. This makes it possible to provide an ink jet print head that can print excellent, high-definition images without any difference in ink ejection amount among the plurality of ejection ports in the same nozzle row.

Second Embodiment

A second embodiment of the present invention will be described below.

In the first embodiment, the electric resistance values of the heating resistors arranged in the same nozzle row are equalized to uniformize the bubbling energy generated by the heating resistors. However, in the configuration of the print head portion, an electric wiring tape (electric wiring substrate) and the electric contact substrate are connected to the print element substrate, on which the heating resistors are arranged, in order to supply energy to the heating resistors. Energy from the printing apparatus is supplied to the heating resistors via the electric contact substrate. Thus, the energy supplied to the heating resistors may vary as a result of a variation in the wiring electric resistance of the electric wiring tape or electric contact substrate or a variation in connecting electric resistance of the connection portion of the electric wiring tape or electric contact substrate.

Thus, in the present example, measurements are made of the wiring electric resistances of the electric wiring tape and electric contact substrate, connected to the heating resistors, and the connecting electric resistances, resulting from the connections, to execute the anneal process on the basis of the measurements. This makes it possible to uniformize the bubbling energy of the heating resistors.

Description will be given of a method of executing the anneal process on the basis of the measurements of the wiring electric resistance and the connecting electric resistance.

Figure 10:
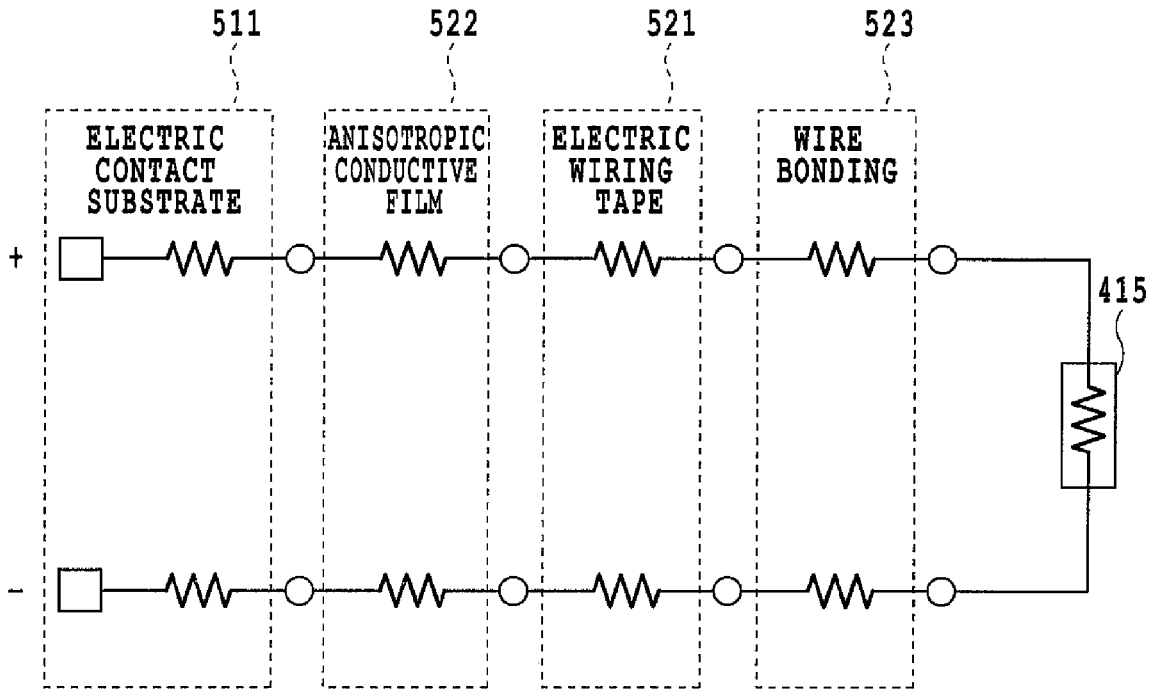
FIG. 10 is a schematic diagram of a wiring circuit in an ink jet print head in accordance with a second embodiment of the present invention.

FIG. 10 is a schematic diagram of wiring connected to the heating resistor 415.

An energy supply path from the printing apparatus in the left of FIG. 10 to the heating resistor 415 passes through the electric contact substrate 511 and an electric wiring tape 521 which are connected to the carriage 302 in the printing apparatus. The electric wiring tape 521 connects the electric contact substrate 511 to the print element substrate, on which the heating resistors 415 are arranged. The electric contact substrate 511 and the electric wiring tape 521 are connected together by an anisotropic conductive film 522. The electric wiring tape 521 and the print element substrate are connected together by a wire bond 523. In the energy supply path, the electric resistance may vary as a result of a variation among manufactured parts or a variation in conditions for a connecting step. Thus, in the present example, the anneal process on the heating resistor 415 is controlled to avoid the variation in wiring electric resistance or connecting electric resistance.

The anneal process on the heating resistor 415 is executed by pre-measuring the electric resistance of the wiring connected to the heating resistor 415 and of the heating resistor 415 and applying a short-pulse voltage on the basis of the measurements. The conditions for the anneal process included a driving frequency of 15 kHz, an applied pulse width of 1 μsec, and an applied pulse count of 300. The applied voltage had energy that was 1.70 times as high as that of the bubbling start voltage Vth. In this case, application of 300 pulses at a time varies not only the resistance value of the heating resistor 415 but also the energy amount as described above. Thus, 300 pulses, corresponding to the total pulse count, are divided into a plurality of sets. A predetermined number of pulses included in each of the resulting sets are applied to heating resistor 415. The wiring electric resistance, the connecting electric resistance, and the resistance value of the heating resistor are then measured. The applied voltage is then varied depending on a variation in resistance value so as to maintain a fixed energy amount. This was repeated to apply the total number of pulses to the heating resistor. As an example in which a total number of pulses are divided into sets, the 300 pulses were divided into a set of 10 pulses, a set of 20 pulses, a set of 20 pulses, a set of 50 pulses, a set of 100 pulses, and a set of 100 pulses. Every time one of the pulse sets was applied to heating resistor 415, the resistance value of the heating resistor 415 was measured. Application of the pulses was repeated. The reason why the small number of applied pulses and thus the small pulse application intervals were initially used is that the resistance value of the CrSiN film initially varies significantly.

Applying the pulses under these conditions reduced the resistance value of the heating resistor 415. An electric resistivity of 450Ω/□, corresponding to a target value, was finally obtained. Thus, the decrease rate of the resistance value of the heating resistor 415 varies depending on the applied voltage, which is varied by the coefficient by which the bubbling start voltage Vth is multiplied. Therefore, to obtain the desired resistance value, it is possible to estimate the decrease rate of the resistance value and to multiply Vth by the coefficient corresponding to the decrease rate to obtain the applied voltage so that the anneal process can be executed using the applied voltage.

The above control of the anneal process has been found to avoid a variation in the electric resistance of the wiring connected to the heating resistor and in the electric resistance of the connection, providing the heating resistor with a uniform electric resistance value. This makes it possible to provide an ink jet print head that can print excellent, high-definition images without any difference in ink ejection amount among the plurality of ejection ports in the same nozzle row. Furthermore, the anneal process does not require a long time.

Third Embodiment

In the first embodiment, the electric resistance values of the heating resistors arranged in the same nozzle row are equalized to uniformize the bubbling energy generated by the heating resistors. However, as shown in FIG. 5, the protective film 706 and the cavitation resistant layer 707 are provided on the top surface of the heating resistor; the protective film 706 protects the heating resistor from ink corrosion, and the cavitation resistant layer 707 protects the heating resistor from cavitation caused by ejection of ink droplets. Thus, even with the uniform electric resistance of the heating resistors, the bubbling energy generated by the plurality of heating resistors arranged in the same nozzle row may vary as a result of a variation in the thickness of the protective film 706 or the cavitation resistant film 707.

Figure 11:
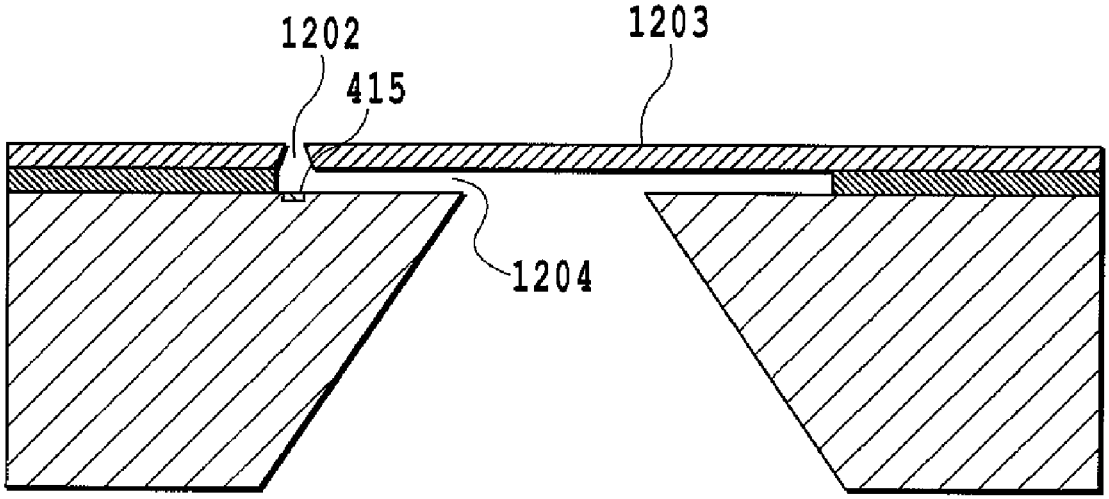
FIG. 11 is an enlarged sectional view of a nozzle portion of an ink jet print head in accordance with a third embodiment of the present invention.

Furthermore, as shown in FIG. 11, when an ejection port 1202 formed above the heating resistor 415 ejects ink droplets, the state of ink bubbling in the same nozzle row may change as a result of a variation in the area of the ejection port 1202 or in the volume of an ink supply port 1204. The ink supply port 1204 is formed between an ejection port plate 1202 in which the ejection port 1202 is formed and the print element substrate, on which the heating resistor 415 is located.

Thus, in the present example, the volume and ejection speed of ink droplets ejected from the ejection port 1202 are measured to execute the anneal process on the basis of the measurements. This makes it possible to uniformize the bubbling energy generated by the plurality of heating resistors in the same nozzle row as well as the ejection state of ink droplets.

Description will be given of a method of executing such an anneal process on the heating resistor.

Such an anneal process as described above in the first or second embodiment is pre-executed on each heating resistor to allow the heating resistor to bubble ink. For example, means for sucking ink from the ejection port 1202 is used to feed ink to the ejection port 1202 and on the heating resistor.

In this state, energy of a magnitude that is 1.20 times as large as that of the bubbling start voltage Vth, corresponding to an actual use condition, is applied to the heating resistor to bubble the ink on the heating resistor to eject the ink from the ejection port 1202.

Then, an image pickup device using a high speed camera or stroboscopic illumination is used to measure the volume and ejection speed of ejected ink droplets. On the basis of the measurements, the anneal process is executed on the heating resistor to vary the sheet resistance value of the heating resistor. The bubbling energy generated by the heating resistors is thus uniformized. For the anneal process, the ink present on the heating resistor may reduce anneal efficiency. Thus, before the anneal process, the ink on the heating resistor is preferably removed using the means for sucking ink from the ejection port 1202.

This anneal process successfully avoided a variation in the film thickness of the protective film and cavitation film, provided on the top surface of the heating resistor, a variation in the area of the ink ejection port, and a variation in the volume of the ink supply port. This has been found to uniformize the bubbling energy generated by the heating resistors and the ejection state of ink droplets. It is thus possible to provide an ink jet print head that can print excellent, high-definition images without any difference in ink ejection amount among the plurality of ejection ports in the same nozzle row and in the impacting positions of ink droplets.

Fourth Embodiment

For example, in the conventional print head portion configured as described above with reference to FIGS. 6 to 8, the heating resistor (heater) 415 allowing 5 pl of ink droplets to be ejected is square and has a width 24.0 μm and length 24.0 μm as well as a resistance value of 350Ω. The heating resistor driving MOS transistor in the transistor array 42 which drives the heating resistor 415 has an on resistance of 23Ω. The resistance of the wire from the transistor to the heating resistor 415 is 16.0Ω, and the other wiring resistances are 5Ω. A 22.0-V driving voltage of pulse width 0.8 μs is applied to the heating resistor 415 to cause a current of 55 mA to flow through the heating resistor 415.

The heating resistor (heater) 415 allowing 2 pl of ink droplets to be ejected is square and has a width 19.2 μm and length 19.2 μm as well as a resistance value of 350Ω. The heating resistor driving MOS transistor in the transistor array 42 which drives the heating resistor 415 has an on resistance of 23Ω. The resistance of the wire from the transistor to the heating resistor 415 is 16.0Ω, and the other wiring resistances are 5Ω. A 17.5-V driving voltage of pulse width 0.8 μs is applied to the heating resistor 415 to cause a current of 55 mA to flow through the heating resistor 415.

The driving voltage (Vop) for the heating resistor 415 allowing 5 pl of ink droplets to be ejected is 22.0 V, which is determined by multiplying the minimum ejection driving voltage (Vth) required to eject 5 pl of ink droplets, by 1.15 (Vop=Vth×1.15). Similarly, the driving voltage (Vop) for the heating resistor 415 allowing 2 pl of ink droplets to be ejected is 17.5 V, which is determined by multiplying the minimum ejection driving voltage (Vth) required to eject 2 pl of ink droplets, by 1.15 (Vop=Vth×1.15).

Thus, a driving voltage of 22.0V is required to eject 5 pl of ink droplets. A driving voltage of 17.5 V is required to eject 2 pl of ink droplets. That is, two power sources are required.

If the driving voltage required to eject 2 pl of ink droplets is set at 22.0 V, which is equal to the driving voltage required to eject 5 pl of ink droplets, the heating resistor allowing 2 pl of ink droplets to be ejected has a width of 14.0 μm and a length of 26.0 μm and thus has a vertically long shape with an aspect ratio of about 1:2. The present inventor's experiments and observations indicate that when the heating resistor is vertically long, ink ejection direction or angle is significantly affected by the positional deviation of the heating resistor (within the tolerance) or the positional deviation of the ejection port from the heating resistor (within the tolerance). When the heating resistor suffers this adverse effect, the ink droplets are likely to impact the print medium at the incorrect positions or bubbles are likely to remain in the nozzles as a result of consecutive ejections of ink droplets. Consequently, the heating resistor is preferably almost square; this is the optimum shape for improving ink ejection stability and image quality. To drive substantially square heating resistors of different sizes using the same driving voltage, the heating resistors of the different sizes need to have different resistance values.

In view of this, in the present embodiment, heating resistors of different resistance values are formed on the same substrate. A method for forming the heating resistors will be described below.

First, as in the case of FIG. 5, described above, the thermal storage layer 702 of film thickness 1.8 μm is formed on the silicon substrate 701 by thermal oxidation. A $SiO_2$ film serving as the interlayer film 703 and also as a thermal storage layer was then formed on the thermal storage layer 702 to a film thickness of 1.2 μm by plasma CVD. A CrSiN film was then formed to a film thickness of 40 nm as the heating resistant layer 704 forming the heating resistor 415. At this time, the gas flow rate was 60 sccm for an Ar gas and 20 sccm for an N2 gas. Power of 500 W was introduced into a target of 30 at % of Cr and 70 at % of Si. The atmosphere temperature was 200° C., and the substrate temperature was 200° C.

An Al—Cu film was formed to a film thickness of 550 nm by sputtering as the metal wire 705 used to allow the thermal action portion 708 to heat the heating resistant layer 704. A pattern was then formed on the Al—Cu film by etching using photolithography. The Al—Cu layer was then removed so as to leave a 15 μm×40 μm portion constituting the heating resistor 415. The thermal action portion 708 was then formed. A SiN film as the protective film 706 was subsequently formed to a film thickness of 1 μm by plasma CVD.

A Ta film as the cavitation resistant layer 707 was formed to a film thickness of 200 nm by sputtering to complete a print head base. The heating resistant layer 704 had a resistivity of 900Ω/□.

After the CrSiN film as the heating resistant layer 704 was formed, a pulse anneal process was executed on the heating resistor allowing 5 pl of ink droplets to be ejected and the heating resistor allowing 2 pl of ink droplets to be ejected.

First, a short-pulse voltage is applied to the heating resistor allowing 5 pl of ink droplets to be ejected to execute the anneal process on the heating resistor. The conditions for the anneal process included a driving frequency of 15 kHz, an applied pulse width of 1 μsec, and an applied pulse count of 300. The applied voltage had energy that was 1.70 times as high as that of the bubbling start voltage Vth. In this case, application of 300 pulses at a time varies not only the resistance value of the heating resistor but also the energy amount as described above. Thus, 300 pulses, corresponding to the total pulse count, are divided into a plurality of sets. A predetermined number of pulses included in each of the resulting sets are applied to heating resistor. The wiring electric resistance of the heating resistor is then measured. The applied voltage is then varied depending on a variation in the measured resistance value so as to maintain a fixed energy amount. This was repeated to apply the total number of pulses to the heating resistor. As an example in which a total number of pulses are divided into sets, the 300 pulses were divided into a set of 10 pulses, a set of 20 pulses, a set of 20 pulses, a set of 50 pulses, a set of 100 pulses, and a set of 100 pulses. Every time one of the pulse sets was applied to heating resistor, the resistance value of the heating resistor was measured. Application of the pulses was repeated. The reason why the small number of applied pulses and thus the small pulse application intervals were initially used is that the resistance value of the CrSiN film initially varies significantly.

Then, a short-pulse voltage similar to that applied to the heating resistor allowing 5 pl of ink droplets to be ejected is applied to the heating resistor allowing 2 pl of ink droplets to be ejected to execute the anneal process on the heating resistor. The conditions for the anneal process included a driving frequency of 15 kHz, an applied pulse width of 1 μsec, and an applied pulse count of 300. The applied voltage had energy that was 1.50 times as high as that of the bubbling start voltage Vth.

As described above, the resistance value of the heating resistor is reduced by applying the pulse to the heating resistor to execute the anneal process thereon. Finally, the heating resistor allowing 5 pl of ink droplets to be ejected exhibited a resistivity of 450Ω/□. The heating resistor allowing 2 pl of ink droplets to be ejected exhibited a resistivity of 600Ω/□. Thus, the decrease rate of the resistance value of the heating resistor varies depending on the applied voltage, which is varied by the coefficient by which the bubbling start voltage Vth is multiplied. Therefore, to obtain the desired resistance value, it is possible to estimate the decrease rate of the resistance value and to multiply Vth by the coefficient corresponding to the decrease rate to obtain the applied voltage so that a pulse anneal process can be executed using the applied voltage.

In the present example, with the wafer completed, that is, with the heating resistor layer formed on the substrate, a pulse voltage was applied to the heating resistor by the electrode pad portion via the probe pin. However, the pulse voltage may be applied to the heating resistor in a final state in which the ink jet head is completed.

The crystal structure of the heating resistor having a resistivity of 450Ω/□ or 600Ω/□ is in a stable state in which microcrystals made of Cr and Si and having a size of 1 to 2 nm are scattered in the CrSiN film. The crystal structure also exhibits a stable resistance value.

As described above, the pulse anneal process is used to form the heating resistors of the different resistance values on the same substrate.

Figure 12:
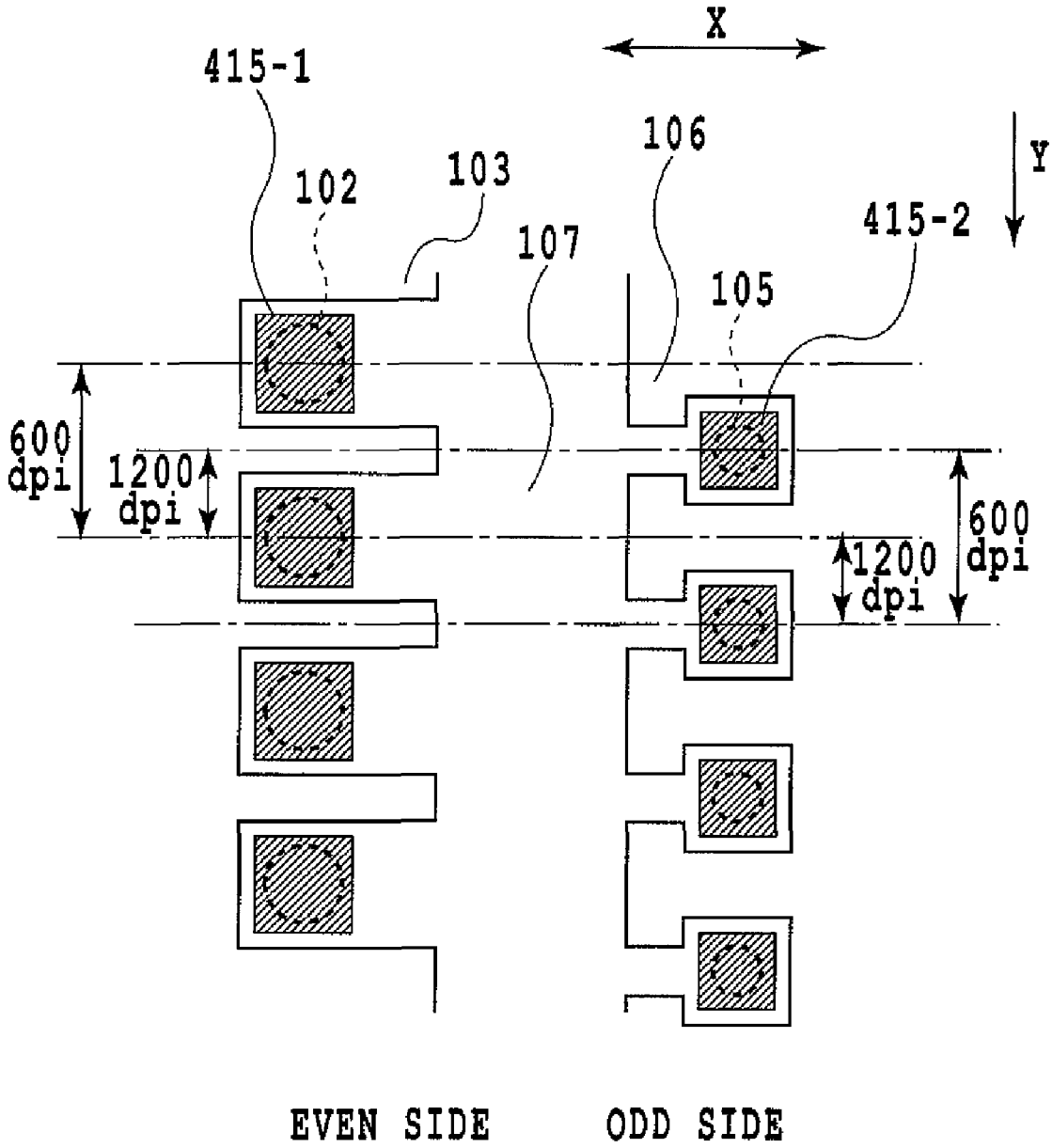
FIG. 12 is an enlarged sectional view of a nozzle portion of an ink jet print head in accordance with a fourth embodiment of the present invention.

FIG. 12 is a diagram of an essential part of the print head portion in accordance with the present embodiment.

An odd row in the left of FIG. 12 is a nozzle row for ejection of 5 pl of ink droplets. An even row in the right of FIG. 12 is a nozzle row for ejection of 2 pl of ink droplets. A plurality of nozzles are arranged at 600 dpi in each row. The nozzle rows are arranged opposite each other across a common liquid chamber 107. Each nozzle on one of the nozzle rows is offset from the corresponding one on the other nozzle row by 1,200 dpi.

Heating resistors 415-1 in the odd row are each square and has a width of 24.0 μm and a length of 24.0 μm as well as a resistivity of 450Ω/□ and a resistance value of 450Ω. An MOS transistor driving the heating resistor 415-1 has an on resistance of 23Ω. The resistance of the wire from the transistor to the heating resistor 415-1 is 16Ω, and the other wiring resistances are 5Ω. A 24.0-V driving voltage of pulse width 0.8 μs is applied to the heating resistor 415-1 to subject the ink on the heating resistor 415-1 to film boiling to eject 5 pl of ink from the ejection port 102. At this time, a current of 49 mA flows through the heating resistor 415-1.

Heating resistors 415-2 in the even row are each substantially square and has a width of 19.2 μm and a length of 21.4 μm as well as a resistivity of 600Ω/□ and a resistance value of 669Ω. An MOS transistor driving the heating resistor 415-2 has an on resistance of 23Ω. The resistance of the wire from the transistor to the heating resistor 415-2 is 16Ω, and the other wiring resistances are 5Ω. A 24.0-V driving voltage of pulse width 0.8 μs is applied to the heating resistor 415-2 to subject the ink on the heating resistor 415-2 to film boiling to eject 2 pl of ink from the ejection port 105. At this time, a current of 34 mA flows through the heating resistor 415-2.

The heating resistors allowing 5 pl of ink droplets and 2 pl of ink droplets, respectively, to be ejected are thus provided with the different resistance values with the shape of the heating resistors remaining unchanged; the heating resistors are square (or almost square). This allows a driving voltage Vop of 24.0 V to be used for both the heating resistors.

As is the case with the present example, in the ink jet print head of the type in which ink is ejected perpendicularly to a heating surface of the heating resistor, the square heating resistor is desirably located immediately below the ejection port. That is, the present inventor's experiments and knowledge indicate that ink ejection efficiency and ink ejection stability increase with decreasing distance, in a plane perpendicular to a heating surface of the heating resistor, between the center of gravity of the heating resistor and the central point of the ejection port. As a result, the ink jet print head in the present example makes it possible to provide an inexpensive ink jet printing apparatus by using a single power source and to provide a reliable ink jet printing apparatus that can offer high image quality.

Figure 13:
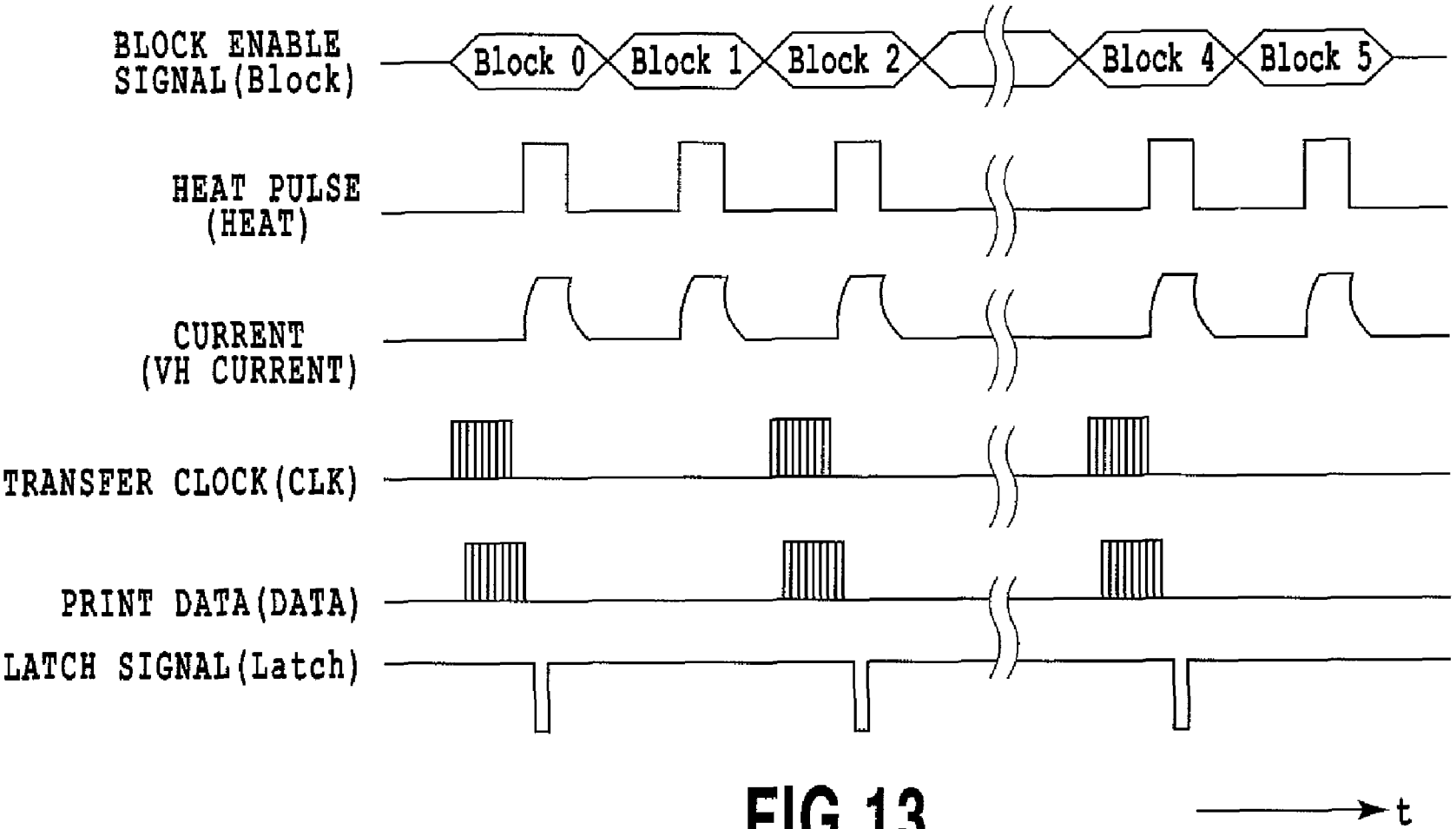
FIG. 13 is a timing chart illustrating driving timings for the ink jet print head in FIG. 12.

FIG. 13 is a timing chart illustrating driving timings for the print head.

The latch circuit 43 (see FIG. 8) latches print data (DATA) output by the shift register 44 in accordance with a latch signal (Latch) input to the input terminal 47. The latch circuit 43 temporarily holds the print data (DATA). The print data (DATA) is output by the shift register 44 in accordance with a transfer clock (CLK). The print data (DATA) serially supplied through the input terminal is input to the shift register 44 and then output to the latch circuit 43 in parallel. Thus, the print head in the present example, shift register 44 is connected to the latch circuit 43. At a certain point in time, the output from the shift register 44 is held by the latch circuit 43.

The plurality of heating resistors (heaters) provided in the print head are divided into a plurality of groups. A selection circuit (not shown) selects one of the plurality of groups which is to be driven. The heat selection circuit selects a particular group in accordance with a block enable signal (Blocks 0 to 8) supplied through the input terminal. A calculation is made of the logical OR of a heat pulse (HEAT) output by the AND circuit 45 in accordance with the print data (DATA) and a select signal output by the selection circuit. A signal corresponding to the logical result is output to the driving driver (heating resistor driving transistor). When the output signal changes to the high level, the corresponding driving driver is turned on to pass current (VH current) through the heating resistor connected to the driving driver. As a result, the heating resistor is driven to generate heat to subject the ink to film boiling. Ink droplets are thus ejected from the corresponding ejection port to form an ink dot on the print medium.

As described above, the present embodiment allows the heating resistors (heaters) in the plurality of nozzles of the different ink ejection amounts to be formed into substantial squares, enabling the same driving voltage to be used for both the heating resistor for the larger ink droplet ejection amount and the heating resistor for the smaller ink droplet ejection amount. This in turn makes it possible to provide an inexpensive ink jet printing apparatus that can print high-quality images.

Fifth Embodiment

Figure 14:
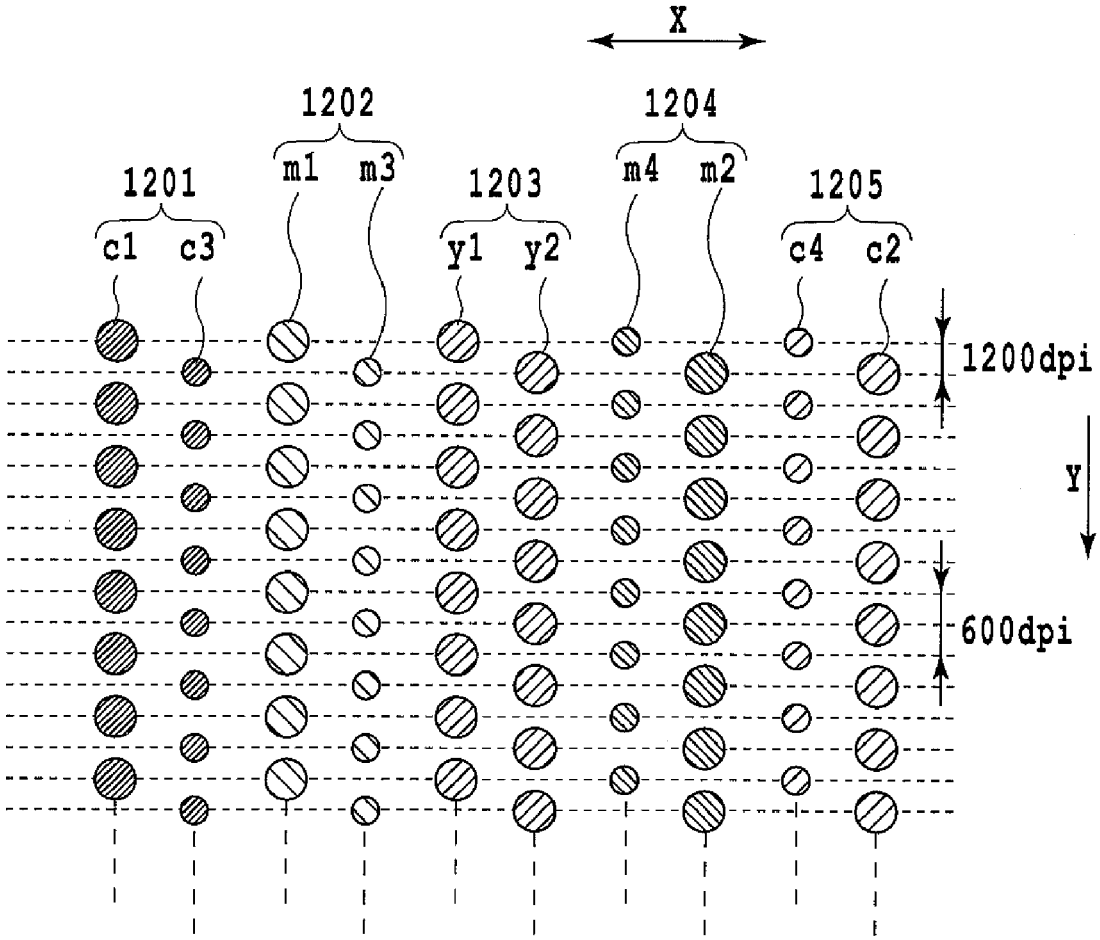
FIG. 14 is an enlarged view of a nozzle portion of an ink jet print head in accordance with a fifth embodiment of the present invention.

As shown in FIG. 14, a print head in accordance with the present embodiment is provided with a first nozzle group 1201 and a second nozzle group 1205 for ejection of cyan ink, a first nozzle group 1202 and a second nozzle group 1204 for ejection of magenta ink, and a nozzle group 1203 for ejection of yellow ink. The first nozzle group 1201 for the cyan ink and the first nozzle group 1202 for the magenta ink are positioned on one side (the left of FIG. 14) of the nozzle group 1203 for the yellow ink. The second nozzle group 1205 for the cyan ink and the second nozzle group 1204 for the magenta ink are positioned on the other side (the right of FIG. 14) of the nozzle group 1203 for the yellow ink. Thus, the nozzle groups for each ink color are provided symmetrically in the main scanning direction, shown by arrow X.

Nozzle rows c1 and c2 are an odd row and an even row from which 5 pl of cyan ink is ejected. Nozzle rows c3 and c4 are an odd row and an even row from which different amounts, 2 pl and 1 pl, respectively, of cyan ink are ejected. Nozzle rows m1 and m2 are an odd row and an even row from which 5 pl of magenta ink is ejected. Nozzle rows m3 and m4 are an odd row and an even row from which 2 pl and 1 pl, respectively, of magenta ink are ejected. Nozzle rows y1 and y2 are an odd row and an even row from which 5 pl of yellow ink is ejected. Each of the nozzle rows include 256 nozzles arranged at 600 dpi (dots/inch).

To form heating resistors provided in these nozzle rows, first, a CrSiN film is formed as is the case with the fourth embodiment. The pulse anneal process is subsequently executed on the heating resistor (heater) allowing 5 pl of ink droplets to be ejected, the heating resistor allowing 2 pl of ink droplets to be ejected, and the heating resistor allowing 1 pl of ink droplets to be ejected, under different conditions.

The following are the conditions under which a short-pulse voltage was applied to the heating resistor allowing 5 pl of ink droplets to be ejected to execute the anneal process on the heating resistor: a driving frequency of 15 kHz, an applied pulse width of 1 μsec, and an applied pulse count of 300. The applied voltage had energy that was 1.67 times as high as that of the bubbling start voltage Vth. In this case, application of 300 pulses at a time varies not only the resistance value of the heating resistor but also the energy amount as described above. Thus, 300 pulses, corresponding to the total pulse count, are divided into a plurality of sets. A predetermined number of pulses included in each of the resulting sets are applied to heating resistor. The resistance value of the heating resistor is then measured. The applied voltage is then varied depending on a variation in resistance value so as to maintain a fixed energy amount. This was repeated to apply the total number of pulses to the heating resistor. As an example in which a total number of pulses are divided into sets, the 300 pulses were divided into a set of 10 pulses, a set of 20 pulses, a set of 20 pulses, a set of 50 pulses, a set of 100 pulses, and a set of 100 pulses. Every time one of the pulse sets was applied to heating resistor, the resistance value of the heating resistor was measured. Application of the pulses was repeated.

The following are the conditions under which a short-pulse voltage was applied to the heating resistor allowing 2 pl of ink droplets to be ejected to execute the anneal process on the heating resistor: a driving frequency of 15 kHz, an applied pulse width of 1 μsec, and an applied pulse count of 300. The applied voltage had energy that was 1.50 times as high as that of the bubbling start voltage Vth.

The following are the conditions under which a short-pulse voltage was applied to the heating resistor allowing 1 pl of ink droplets to be ejected to execute the anneal process on the heating resistor: a driving frequency of 15 kHz, an applied pulse width of 1 μsec, and an applied pulse count of 300. The applied voltage had energy that was 1.40 times as high as that of the bubbling start voltage Vth.

As described above, the resistance value of the heating resistor is reduced by applying the pulse and voltage under the above conditions to the heating resistor to execute the anneal process thereon. Finally, the heating resistor allowing 5 pl of ink droplets to be ejected exhibited a sheet resistivity of 500Ω/□. The heating resistor allowing 2 pl of ink droplets to be ejected exhibited a sheet resistivity of 600Ω/□. The heating resistor allowing 1 pl of ink droplets to be ejected exhibited a sheet resistivity of 680Ω/□.

Figure 15:
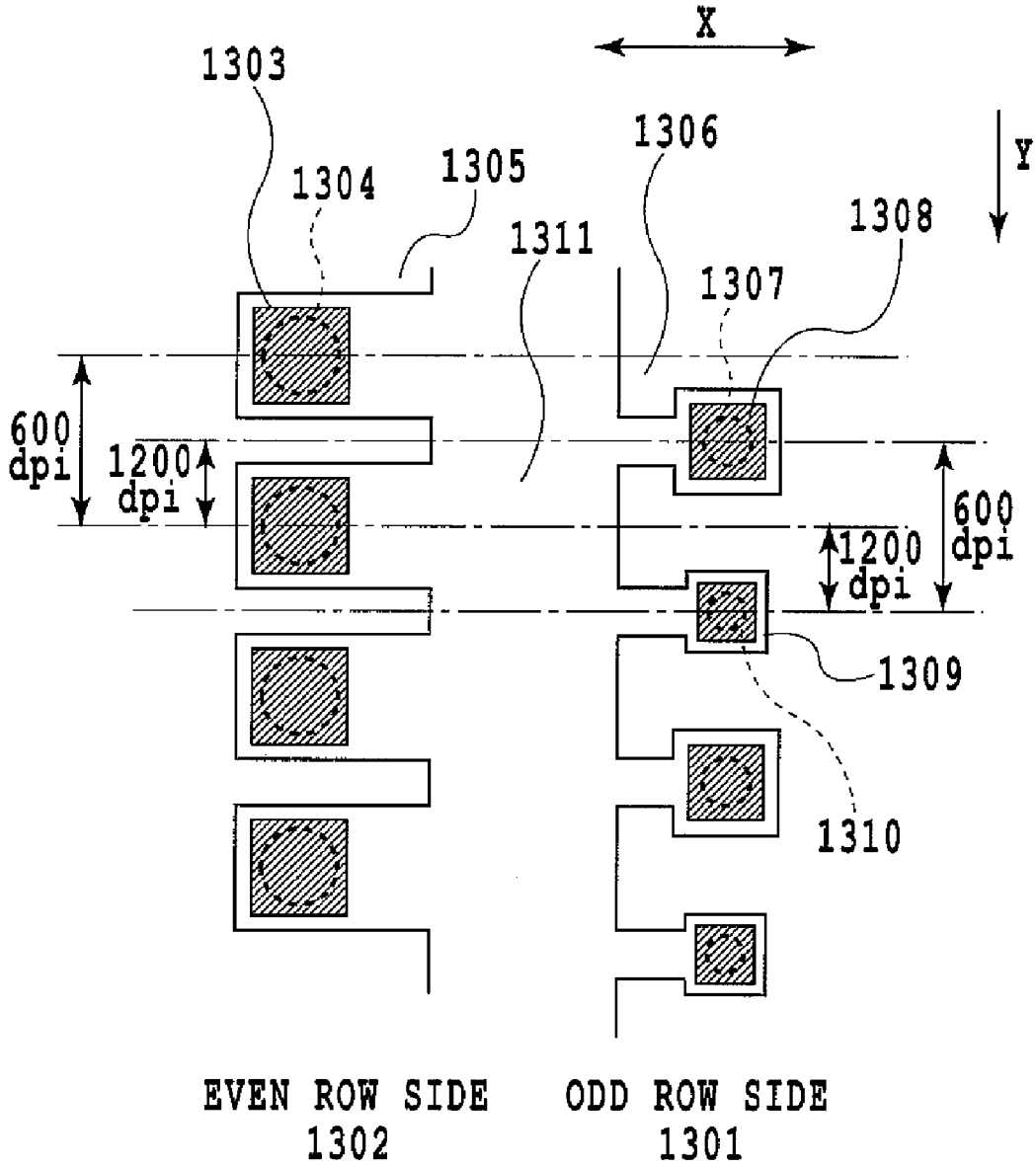
FIG. 15 is a diagram illustrating the nozzle portion of the ink jet print head in FIG. 14.
Figure 16A:
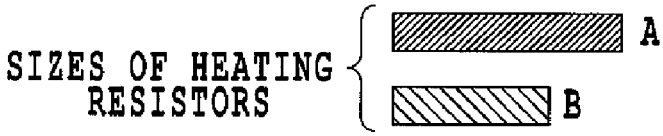
FIGS. 16A, 16B, and 16C are diagrams illustrating driving conditions for heating resistors of different sizes.
Figure 16B:
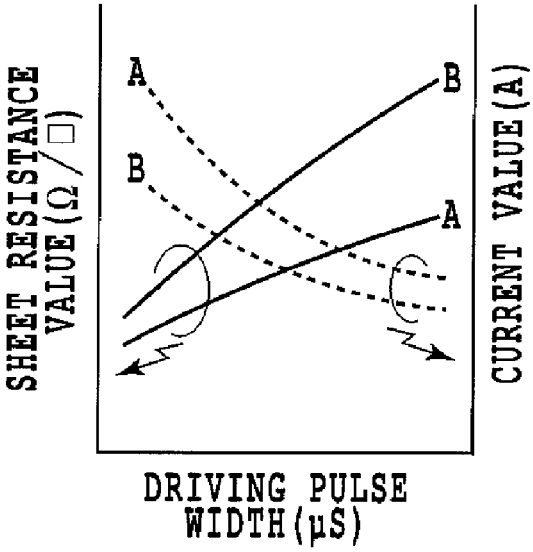
Figure 16C:
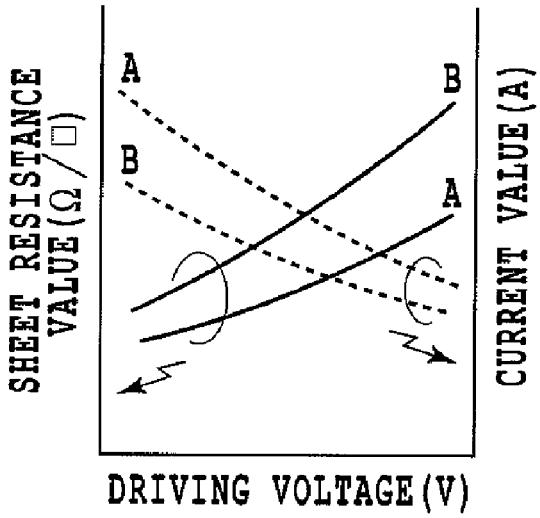

FIG. 15 is a diagram illustrating an essential part of the print head in the present example.

In FIG. 15, an odd nozzle row 1302 ejects 5 pl of ink droplets. An even nozzle row 1301 ejects 2 pl and 1 pl of ink droplets. The nozzle rows are arranged opposite each other across a common liquid chamber 1311. The nozzles are arranged at 600 dpi in each row. Each nozzle on one of the nozzle rows is offset from the corresponding one on the other nozzle row by 1,200 dpi. Reference numerals 1303 and 1304 denote a heating resistor and an ejection port which allow 5 pl of ink droplets to be ejected. Reference numerals 1308 and 1307 denote a heating resistor and an ejection port which allow 2 pl of ink droplets to be ejected. Reference numerals 1309 and 1310 denote a heating resistor and an ejection port which allow 1 pl of ink droplets to be ejected. The pulse anneal process is executed on each of the heating resistors 1303, 1308, and 1309 as described above.

The heating resistor 1308 allowing 2 pl of ink droplets to be ejected is substantially square and has a width of 17.9 μm and a length of 21.2 μm as well as a sheet resistivity of 600Ω/□ and a heater resistance value of 710.6Ω. An MOS transistor driving the heating resistor 1308 has an on resistance of 23Ω. The resistance of the wire from the transistor to the heating resistor 1308 is 16Ω, and the other wiring resistances are 5Ω. A 24.0-V driving voltage of pulse width 0.8 μs is applied to the heating resistor 1308 to subject the ink on the heating resistor 1308 to film boiling to eject 2 pl of ink from the ejection port 1307. At this time, a current of 32 mA flows through the heating resistor 1308.

The heating resistor 1309 allowing 1 pl of ink droplets to be ejected is substantially square and has a width of 15.4 μm and a length of 20.2 μm as well as a sheet resistivity of 680Ω/□ and a heater resistance value of 891.9Ω. An MOS transistor driving the heating resistor 1309 has an on resistance of 23Ω. The resistance of the wire from the transistor to the heating resistor 1309 is 16Ω, and the other wiring resistances are 5Ω. A 24.0-V driving voltage of pulse width 0.8 μs is applied to the heating resistor 1309 to subject the ink on the heating resistor 1309 to film boiling to eject 1 pl of ink from the ejection port 1310. At this time, a current of 26 mA flows through the heating resistor 1309.

The heating resistor 1303 allowing 5 pl of ink droplets to be ejected is substantially square and has a width of 25.8 μm and a length of 22.5 μm as well as a sheet resistivity of 500Ω/□ and a heater resistance value of 436.0Ω. An MOS transistor driving the heating resistor 1303 has an on resistance of 23Ω. The resistance of the wire from the transistor to the heating resistor 1303 is 16Ω, and the other wiring resistances are 5Ω. A 24.0-V driving voltage of pulse width 0.8 μs is applied to the heating resistor 1303 to subject the ink on the heating resistor 1303 to film boiling to eject 5 pl of ink from the ejection port 1304. At this time, a current of 50 mA flows through the heating resistor 1303.

By thus providing the different sheet resistance values for the heat resistors allowing 5 pl, 2 pl, and 1 pl of ink droplets to be ejected, it is possible to form the heating resistors into substantial squares to allow the same driving voltage Vop of 24.0 V to be used for all the heating resistors.

Other Embodiments

The ink jet print head in accordance with the present invention is not limited to the one constituting a tank holder such as that described above. The ink jet print head may constitute the ink jet cartridge together with the ink tank or may be separate from the ink tank. Furthermore, the present invention can be used not only as an ink jet print head used for a serial type printing apparatus but is also widely available as an ink jet print head that can eject ink droplets. The present invention is also applicable to an elongate ink jet print head extending all over the print area on the print medium in the width direction. The elongate ink jet print head is used for what is called a full line type printing apparatus.

Furthermore, the present invention has only to be able to form an electrothermal converter that uses a heating resistor having the sheet resistance value thereof varied by the anneal process to generate ink ejection energy. The material of the heating resistor is not limited to those described in the above embodiments. The anneal process has only to be able to apply energy to the heating resistor to vary the sheet resistance value thereof. Instead of the scheme of applying a pulse voltage to the heating resistor as described above, for example, a scheme of heating the heating resistor may be used. If any voltage is applied to the heating resistor for the anneal process, the sheet resistance value of the heating resistor can be optimized by controlling the magnitude and/or pulse width of the voltage depending on the circuit resistance of the electric circuit for the heating resistor as described above in the second embodiment. If a plurality of heating resistors are formed on the same substrate, the heating resistors may be positioned on the same nozzle row or on different nozzle rows.

Various materials can be used as the material of the heating resistor. It is essential only that the heating resistor is made of a material having a sheet resistance value which is able to be varied depending on energy provided by an anneal process. The heating resistor may include first and second heating resistors; sheet resistance values of the first and second heating resistors are set at different values by adjusting the sheet resistance value of at least one of the first and second heating resistors by the anneal process.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-344632, filed Dec. 21, 2006, which is hereby incorporated by reference herein in its entirety.

What is claimed is:

1. A method for manufacturing an ink jet print head that is able to eject ink droplet droplets utilizing heat generated by heating resistors, the method comprising the steps of:

forming, as the heating resistors, first and second heating resistors on the same substrate, each of the first and second heating resistors being made of a material having a sheet resistance value able to be varied depending on energy; and adjusting the sheet resistance value of at least one of the first and second heating resistors by an anneal process so that the sheet resistance values of the first and second heating resistors are set at different values, wherein the first heating resistor allows a larger ink droplet to be ejected, and the second heating resistor allows a smaller ink droplet to be ejected, and the anneal process makes adjustment such that the sheet resistance value of the first heating resistor is smaller than that of the second heating resistor.

2. The method for manufacturing the ink jet print head according to claim 1, wherein the applied energy is controlled on the basis of a desired amount and/or ejection speed of ink droplets ejected by heat generated by at least one of the first and second heating resistors.

3. The method for manufacturing the ink jet print head according to claim 1, wherein the anneal process is executed by applying a pulse-like voltage to at least one of the first and second heating resistors, and the sheet resistance value of at least one of the first and second heating resistors to which the voltage is applied is adjusted by varying the magnitude and/or pulse width of the voltage.

4. The method for manufacturing the ink jet print head according to claim 3, wherein the magnitude and/or pulse width of the voltage is controlled in accordance with a circuit resistance of an electric circuit for at least one of the first and second heating resistors to which the voltage is to be applied.

5. The method for manufacturing the ink jet print head according to claim 1, wherein each of the first and second heating resistors is formed of a CrSiN film.

6. The method for manufacturing the ink jet print head according to claim 1, wherein each of the first and second heating resistors is rectangular with an aspect ratio of 1.2 to 0.8.

* * * * *